United States Patent [19]

Yamaga et al.

[11] 4,282,788

[45] Aug. 11, 1981

[54] ELECTRONIC MUSICAL INSTRUMENT WITH AUTOMATIC CHORD PERFORMANCE DEVICE

[75] Inventors: Eiichi Yamaga; Junji Iio; Toshio Takeda; Akira Nakada; Akio Imamura, all of Hamamatsu, Japan

[73] Assignee: Nippon Gakki Seizo Kabushiki Kaisha, Hamamatsu, Japan

[21] Appl. No.: 97,717

[22] Filed: Nov. 27, 1979

[30] Foreign Application Priority Data

Nov. 27, 1978 [JP] Japan ..... 53/146168

[51] Int. Cl.[3] ..... G10F 1/00

[52] U.S. Cl. ..... 84/1.03; 84/DIG. 12; 84/DIG. 22

[58] Field of Search ..... 84/1.03, DIG. 12, DIG. 22, 84/1.24, 1.26

[56] References Cited

U.S. PATENT DOCUMENTS 4,186,642 2/1980 Gross ..... 84/1.24

4,202,236 5/1980 Wilcox et al. ..... 84/DIG. 12

*Primary Examiner*—J. V. Truhe

*Assistant Examiner*—Forester W. Isen

*Attorney, Agent, or Firm*—Spensley, Horn, Jubas & Lubitz

[57] ABSTRACT

An electronic musical instrument with an automatic chord performance device is of a type in which chord tones of plural series of different tone colors in different rhythm patterns are produced. This instrument employs a memory for storing a plurality of patterns per one rhythm and for plural rhythms in order to simultaneously obtain the chord tones of plural series per one rhythm. The patterns are read from the memory as tone generation timing signals. These tone generation timing signals control the amplitudes of the envelopes of the chord tone signals. The chord tone signals thus controlled in amplitude are generated after being controlled in the tone color in each of the series.

16 Claims, 14 Drawing Figures

| TIME SLOT | | 1 | 2 3 | 4 5 6 | 7 8 9 | 10 11 12 | 13 14 15 | 16 17 18 | 19 20 21 | 22 23 24 | 25 26 27 |
|---|---|---|---|---|---|---|---|---|---|---|---|
| BITS | KC1 | 1 | $B_1 N_1$ | $K0_2 B_1 N_1$ | $K0_2 B_1 N_1$ | ← | ← | ← | ← | ← | ← |
| | KC2 | 1 | $B_2 N_2$ | $B_2 N_2$ | $B_2 N_2$ | | | | | | |
| | KC3 | 1 | $B_3 N_3$ | $B_3 N_3$ | $B_3 N_3$ | | | | | | |
| | KC4 | 1 | $K0_1 N_4$ | $K0_3 K0_1 N_4$ | $K0_3 K0_1 N_4$ | | | | | | |
| KEYBOARD | | | PK | UK | UK | UK | UK | UK | UK | UK | LK |
| CHANNEL | | 1 | | 4 | 7 | 10 | 13 | 16 | 2 | 5 | 8 |

| TIME SLOT | | 28 29 30 | 31 32 33 | 34 35 36 | 37 38 39 | 40 41 42 | 43 44 45 | 46 47 48 | 49 50 51 | 52 53 54 |
|---|---|---|---|---|---|---|---|---|---|---|
| BITS | KC1 | $K0_2 B_1 N_1$ | ← | ← | ← | ← | ← | $K0_2 B_1 N_1$ | $K0_2 B_1 N_1$ | $K0_2 B_1 N_1$ |
| | KC2 | $B_2 N_2$ | | | | | | SR $B_2 N_2$ | ACI $B_2 N_2$ | $B_2 N_2$ |
| | KC3 | $B_3 N_3$ | | | | | | BL $B_3 N_3$ | ACII $B_3 N_3$ | $B_3 N_3$ |
| | KC4 | $K0_3 K0_1 N_4$ | | | | | | ACC $N_4$ | ACIII $N_4$ | $N_4$ |
| KEYBOARD | | LK | LK | LK | LK | LK | LK | ARP1 | ARP2 | ARP3 |
| CHANNEL | | 11 | 14 | 17 | 3 | 6 | 9 | 12 | 15 | 18 |

FIG.5

UPPER KEYBOARD ENVELOPE CONTROL
LOWER KEYBOARD ENVELOPE CONTROL
SHIFT REGISTER
LATCH
DECODER
DECODER
UED
LED
ACED
OD
ND
LA
US5
US4
US3
US2
US1
UFA
USA
LS5
LS4
LS3
LS2
LS1
LFA
LSA
KO1
LGS3
LGS2
LGS1
AUAT
LCON
LDMP
KO1
KO3
UGS3
UGS2
UGS1
AUAT
UCON
UDMP
KO1
KO3
FD3
FD4
KC1
KC2
KC3
KC4
ACED3 (ACC) (ACIII)
ACED2 (BL) (ACII)
ACED1 (SR) (ACI)
OD5
OD4
OD3
OD2
OD1
NCL
N4
ND4.7
ND6
ND5
ND3
ND2
ND1
836
839
838
821
822
823
824
825
826
827
828
829
830
831
832
833
834
835
836
837
AN11
AN12
AN13
OR3
OR4
OR5
NR1
DF2
DF3
DF4
DF5
DF6
DF7
DF8
DF9
DF10
DF11
DF12

ELECTRONIC MUSICAL INSTRUMENT WITH AUTOMATIC CHORD PERFORMANCE DEVICE

BACKGROUND OF THE INVENTION

This invention relates to an electronic musical instrument with an automatic chord performance device capable of simultaneously performing chord tones which are different in tone color by controlling generation of the chord tones in different tone colors in accordance with automatic chord performance patterns of plural systems.

Automatic chord performance devices in a prior art electronic musical instrument are so constructed that a single train of chord tone generation timing signal is generated in accordance with a selected rhythm and the timing for generating tones of the chord which is formed by key depression is controlled by this single train of chord tone generation timing signal.

If it is desired to perform chord tones in different tone colors simultaneously in such prior art devices employing a single train of chord tone generation timing signal, chord tones in any of the available tone colors are generated at the same timing. As a result, the musical performance becomes monotonous and a desirable musical effect which is expected to be derived from performance of the chord tones in plural tone colors can hardly be attained. Suppose, for example, that chord tones of a piano tone and chord tones of a guitar tone are played simultaneously. The two tone colors of chords should preferably be generated at different timing so that characteristics of the piano tone and those of the guitar tone can be fully appreciated by the audience. Despite such requirement, the two tone colors of chords are actually generated simultaneously in those prior art devices with a resulting impaired musical effect in the performance of some musical pieces.

The prior art automatic chord performance devices employing only a single train of chord tone generation timing signal are disadvantageous not only in the simultaneous performance of chords in plural tone colors but also in playing of chord tones in a single tone color. If, for example, a rhythm of a quick tempo is selected, generation of chord tones of a single tone color is controlled by a single chord tone generation timing signal in this quick tempo. In this case, as the tempo becomes quick, interval of pulses of this train of chord tone generation timing signal becomes short even to such an extent that before a decaying portion of one time of chord tones which are controlled to be generated is finished, generation of the next time tones is started. This causes cancellation of the decaying portion of the first chord tones with a result that chord tones having a sufficient long decaying effect cannot be obtained.

SUMMARY OF THE INVENTION

It is, therefore, an object of the invention to provide an automatic chord performance device for an electronic musical instrument which has eliminated the above described disadvantages of the prior art devices.

According to the invention, chord tones of plural series are separately and individually generated in accordance with plural series of automatic chord performance tone generation patterns.

If for example, three series (trains) of chord tones are employed, chord tones of each of the three series are generated separately from the chord tones of the other series in accordance with one of automatic chord performance tone generation patterns which are different from one another. Assuming that the chord tones of the three series have tone colors which are different from one another, generation of each of the chords is controlled by each one tone generation pattern which is different from the other tone generation patterns and, accordingly, chord tones are generated at a desired timing and with a suitable tone color.

If the three series of chord tones are set to be of the same tone color, generation of chord tones at one timing which is of the same tone color as those at the other timing is controlled by an automatic chord performance tone generation pattern which is different from other patterns for other timings so that chord tones with a sufficiently long decaying portion can be produced no matter how quick the tempo of the selected rhythm may be.

According to another aspect of the invention, at least one of chords of plural series of chord tones is controlled in its tone color in accordance with a corresponding automatic chord performance tone generation pattern.

This tone color control is applicable, for example, to production of tone color of "attack wow" by changing frequency, phase or harmonic structure of chord tones in generation of these chord tones. In prior art electronic musical instrument, the time wise control of the tone color for producing "attack wow" effect has been realized by employing a signal of detecting depression of keys in a lower keyboard. The prior art instruments, however, cannot produce "attack wow" by employing the signal of detecting depression of the keys during the automatic chord performance, because the timing of generation of chord tones does not coincide with depression of the keys while the automatic chord is being played. According to the present invention, "attack wow" can be produced by controlling the tone color of the chord tones by utilizing the automatic chord performance tone generation pattterns. Furthermore, according to the invention, chord tones of a tone color with the "attack wow" and chord tones of an ordinary tone color can be generated simultaneously so that a unique musical effect can be produced.

A preferred embodiment of the invention will be described hereinbelow in conjunction with the accompanying drawings.

BRIEF DESCRIPTION OF THE DRAWINGS

FIG. 5 is a time table showing output signals of a data multiplexing circuit shown in FIG. 2;

DESCRIPTION OF A PREFERRED EMBODIMENT

Figure 1:
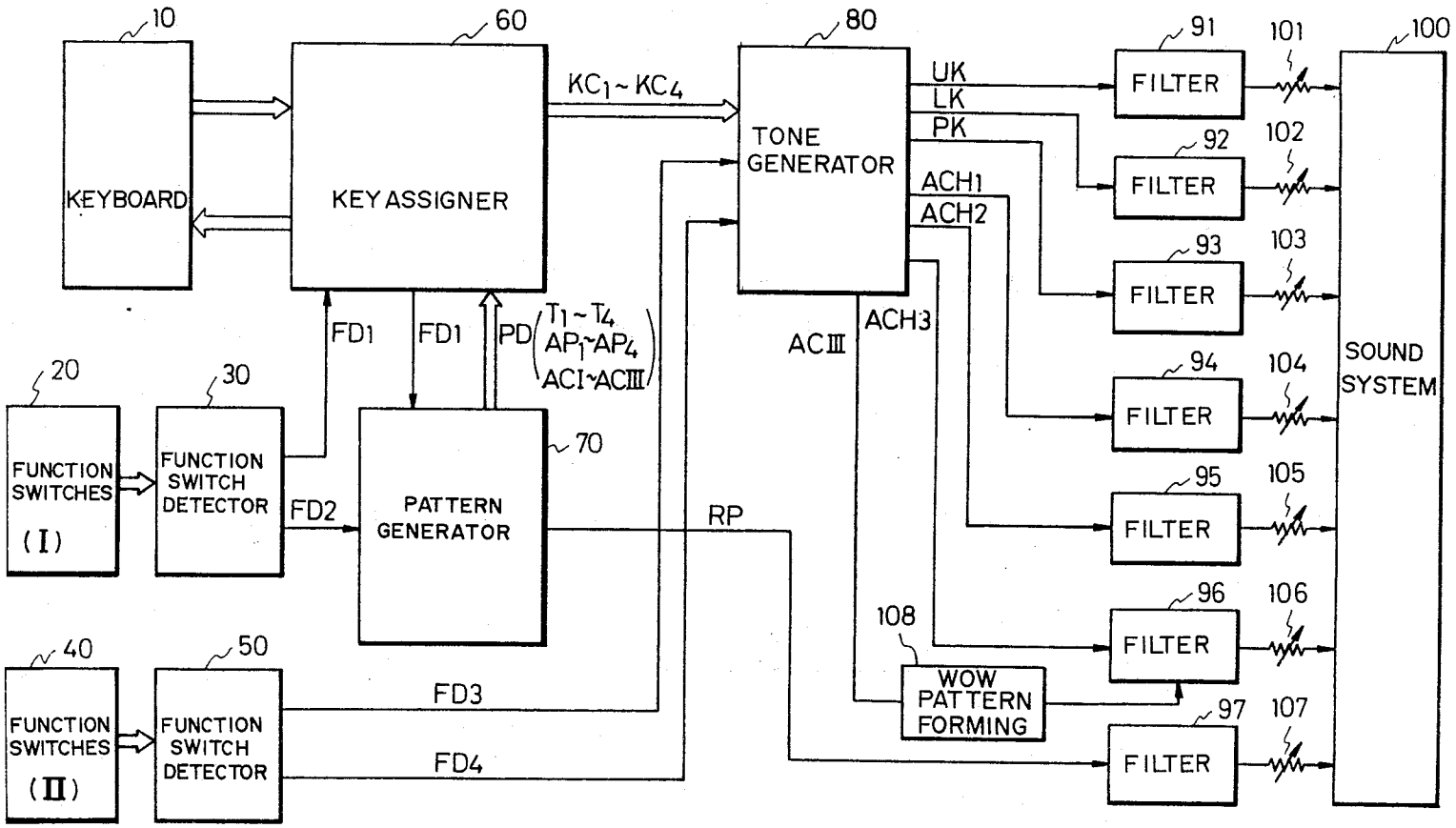
FIG. 1 is a block diagram schematically showing an embodiment of the automatic chord performance device for an electronic musical instrument according to the invention.
Figure 2:
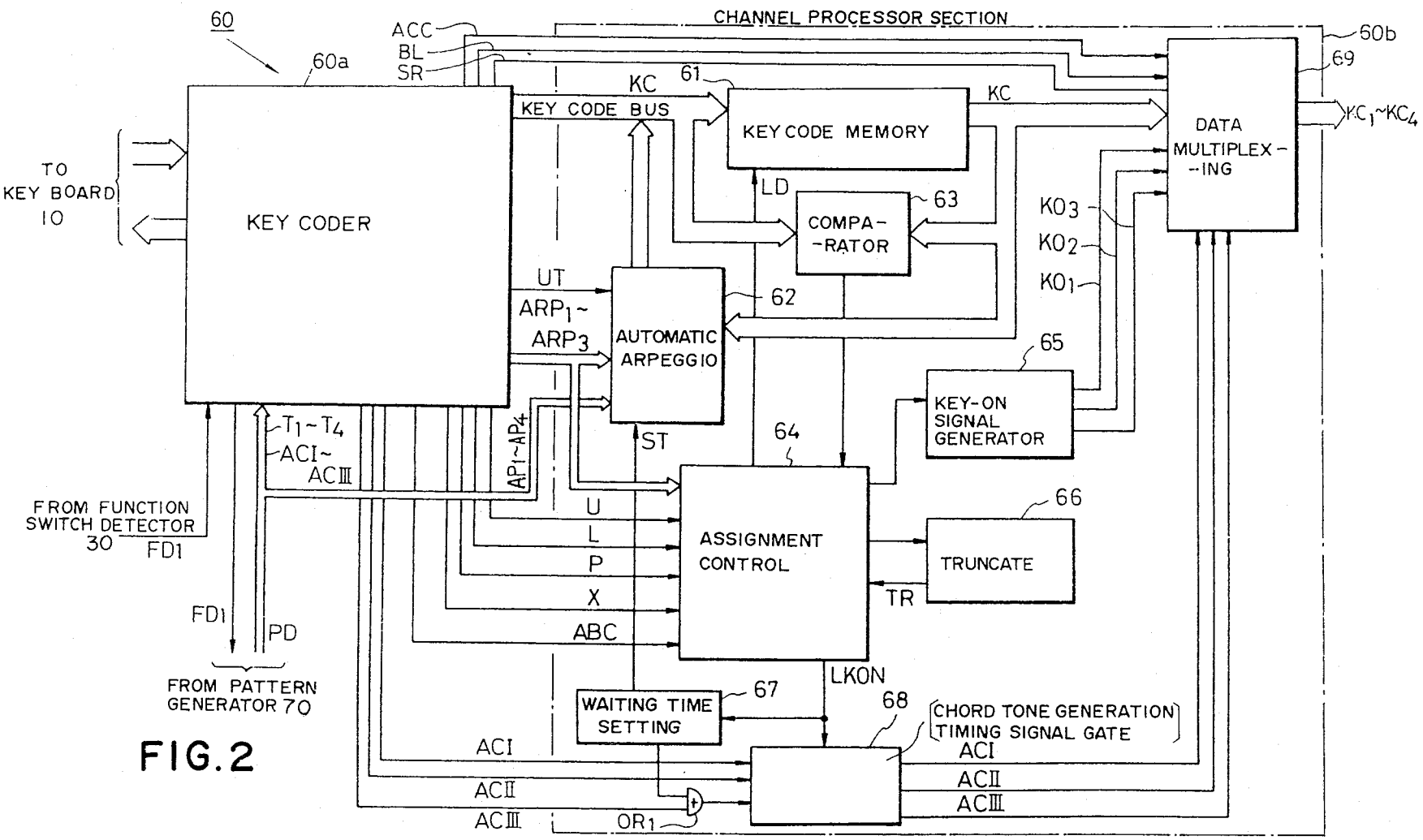
FIG. 2 is a block diagram schematically showing a key assigner appearing in FIG. 1.

Referring first to FIG. 1, a key depressed in a keyboard 10 is detected by a key assigner 60. The key assigner 60 is composed of a key coder section 60*a* and a channel processor section 60*b* as illustrated by a detailed block diagram of FIG. 2. The key coder section 60*a* under-takes generation of key codes representing tones to be produced in accordance with the depressed keys while the channel processor section 60*b* undertakes sequential assignment of these key codes or key codes for an automatic arpeggio formed on the basis of these key codes to a plurality of tone production channels.

Operation of the key coder section 60*a* will be described first in further detail. The operation of the key coder section 60*a* consists of two major functions of (1) a depressed key detection operation for detecting the keys depressed in the keyboard 10 and generating key codes representing the depressed keys and (2) an automatic bass/chord performance key code generation operation for performing an arithmetic operation with respect to the key codes representing the depressed keys in accordance with data FD1 supplied from a function switch detector 30 which detects a function switch (not shown) operated in a function switch section 20 (FIG. 1) and thereby generating key codes for an automatic chord performance and key codes for an automatic bass performance. In the depressed key detection operation, the depressed keys are detected by scanning, in a time sharing fashion, key switches (not shown) which are actuated in response to depression of the keys in the keyboard 10 and key codes KC (each key code consisting of 7-bit digital data i.e. three block-code bits $B_3$, $B_2$, $B_1$ and four note-code bits $N_4$, $N_3$, $N_2$, $N_1$) are generated. The following Tables 1 and 2 each illustrates an example of the note code $N_4$, $N_3$, $N_2$, $N_1$ and of the block code $B_3$, $B_2$, $B_1$ constituting the 7-bit key code KC.

TABLE 1

| Note | Bit $N_4$ | $N_3$ | $N_2$ | $N_1$ |
|---|---|---|---|---|
| C# | 0 | 0 | 0 | 1 |
| D | 0 | 0 | 1 | 0 |
| D# | 0 | 0 | 1 | 1 |
| E | 0 | 1 | 0 | 1 |
| F | 0 | 1 | 1 | 0 |
| F# | 0 | 1 | 1 | 1 |
| G | 1 | 0 | 0 | 1 |
| G# | 1 | 0 | 1 | 0 |

TABLE 1-continued

| Note | Bit $N_4$ | $N_3$ | $N_2$ | $N_1$ |
|---|---|---|---|---|
| A | 1 | 0 | 1 | 1 |
| A# | 1 | 1 | 0 | 1 |
| B | 1 | 1 | 1 | 0 |
| C | 1 | 1 | 0 | 0 |

TABLE 2

| block range | | | $B_3$ | $B_2$ | $B_1$ |
|---|---|---|---|---|---|
| (UK.LK) | | $C_2$ | 0 | 0 | 0 |
| (PK) | | $C_2$ | | | |
| (UK.LK) | $C_2$# | $C_3$ | 0 | 0 | 1 |
| (PK) | $C_2$# | $C_3$ | | | |
| (UK.LK) | $C_3$# | $C_4$ | 0 | 1 | 0 |
| (PK) | $C_3$# | $C_4$ | | | |
| (UK.LK) | $C_4$# | $C_5$ | 0 | 1 | 1 |
| (PK) | $C_4$# | $C_5$ | | | |
| (UK.LK) | $C_5$# | $C_6$ | 1 | 0 | 0 |
| (UK.LK) | $C_6$# | $C_7$ | 1 | 0 | 1 |

UK upper keyboard
LK lower keyboard
PK pedal keyboard

The automatic bass chord performance key code generation operation is performed according to the operation of the function switch section 20. The function switch section 20 includes function switches such as a rhythm selection switch for selecting a desired rhythm for among rhythms including march, waltz, swing, ballade, slow rock, jazz rock, bolero, tango, beguino, rhumba, mambo, bossanova, samba etc.; an automatic bass/chord performance function section switch for selecting a desired automatic bass/chord performance function from among a single finger function, a finger chord function, a custom function etc.; an automatic arpeggio function selection switch for selecting an automatic arpeggio performance; and a up-turn selection switch for selecting either an up mode or a turn mode in the automatic arpeggio performance. These switches are all known in the art and illustration thereof is omitted. States of operation of these function switches in the function switch section 20 are detected by the function switch detector 30. Data representing the operation states of the function switches for selecting a performance function such as the automatic bass/chord function selection switch and the automatic arpeggio function selection switch is turned into serial data and applied to the key coder section 60*a* of the key assigner 60 in the form of the function data FD1. Data representing the operation state of the rhythm selection switch is also turned into serial data and applied to a pattern generator 70 in the form of function data FD2.

The pattern generator 70 consists, for example, of a read-only memory (ROM) and stores, for each rhythm, signals including bass pattern signals each consisting of four bits $T_4$, $T_3$, $T_2$, $T_1$ for controlling the automatic bass performance (including tone pitch data and tone generation timing data), arpeggio pattern signals each consisting of four bits $AP_4$, $AP_3$, $AP_2$, $AP_1$ for controlling the automatic arpeggio performance, and three series of automatic chord performance tone generation pattern signals $ACP_1$, $ACP_2$ and $ACP_3$ according to the present invention.

Upon receipt of the function data FD1 representing operation states of the function switches provided for selecting the above described various performance functions from the function switch detector 30, the key coder 60*a* of the key assigner 60 delivers this function data FD1 to the pattern generator 70. The pattern generator 70 in turn delivers out pattern data corresponding to the selected performance function (designated by the data FD1) and also to the selected rhythm (designated by the data FD2). This pattern data includes a bass pattern signal $T_4$-$T_1$, an arpeggio pattern signal $AP_4$-$AP_1$ and automatic chord performance tone generation pattern signals $ACP_1$-$ACP_3$ (chord tone generation timing signals ACI-ACIII corresponding to the signals $ACP_1$-$ACP_3$). The key coder section 60*a* produces key codes for the automatic bass performance and key codes for the automatic chord performance in accordance with the bass pattern signal $T_4$-$T_1$ in the pattern data PD provided by the pattern generator 70 and the signal representing the operation state of the automatic bass/chord function selection switch in the function data FD1 provided by the function switch detector 30.

If, for example, the single finger function is selected from among the automatic bass/chord performance functions, a key code representing a key being depressed by a single finger in the chord tone playing keyboard (e.g. the lower keyboard) is produced and key codes representing chord constituting tones are also produced in accordance with the type of the chord designated by suitable separate means such as a chord type selection switch. Further, a key code representing a root note for the bass performance is produced in accordance with the key code representing the key being depressed in the chord tone playing keyboard and key codes representing subordinate notes of for the bass performance are produced in accordance with this key code representing the root note, with the type of the chord designated by the separate means and with the bass pattern signal $T_4$-$T_1$ generated by the pattern generator 70.

If the finger chord function is selected, the key codes representing the keys depressed in the chord playing keyboard by three or more fingers are used as key codes representing chord constituting notes. The chord type and the root note of the chord are detected based on the keys depressed in the chord playing keyboard. The key code representing the root note for the bass performance is formed in accordance with the above detected root note and key codes representing subordinate notes for the bass performance are produced in accordance with the aboveformed key code representing the root note for the bass performance, with the detected chord type and with the bass pattern signal $T_4$-$T_1$ generated by the pattern generator 70.

If the custom function is selected, the key codes representing the keys depressed in the chord playing keyboard by three or more fingers are used as key codes representing chord constituting notes. The chord type is detected based on the keys depressed in the chord playing keyboard. The key code representing the single key depressed in a bass tone playing keyboard (i.e. the pedal keyboard) by a foot is used as a key code representing the root note for the bass performance. Key codes representing subordinate notes are produced based on the above key code representing the root note, with the detected chord type and with the bass pattern signal $T_4$-$T_1$ generated by the pattern generator 70.

The key coder section 60*a* also produces, in synchronization with every timing of generation of the key code representing the key depressed in the upper keyboard, an upper keyboard signal U which represents that the key code is for a key in the upper keyboard, and, in synchronization with every timing of generation of the key code representing the key depressed in the lower keyboard, a lower keyboard signal L which represents that the key code is for a key in the lower keyboard. The key coder section 60*a* also produces, in synchronization with every timing of generation of the key code representing the key depressed in the pedal keyboard, a pedal keyboard signal P which represents that the key code is for a key in the pedal keyboard. The key coder section 60*a* further produces an automatic bass/chord signal ABC representing that the automatic bass/chord function has been selecting, signals $ARP_1$-$ARP_3$ representing arpeggio processing times in an automatic appeggio circuit 62 in the channel processor section 60*b* to be described later, and a key-off detection signal X used for detection of key-off in the channel processor section 60*b* to be described later.

The channel processor section 60*b* controls assignment to the respective tone production channels of the key codes representing the depressed keys, the key codes for the automatic bass/chord performance supplied from the key coder section 60*a*, and the key codes for the automatic arpeggio performance generated by the automatic arpeggio circuit 62 based on the above described various signals U, L, P, ABC, $ARP_1$-$ARP_3$ and X.

It will be convenient to describe the tone production channels employed in the present embodiment of the electronic musical instrument before describing the outline of the channel processor section 60*b*. In the present embodiment, there are provided eighteen tone production channels of time-shared time slots. One of the eighteen channels is used exclusively for the pedal keyboard tone, seven channels are used for the upper keyboard tones, another seven for the lower keyboard tones, and the remaining three channels are used exclusively for the automatic arpeggio tones. In other words, exclusive channels are respectively provided for the upper keyboard tones, the lower keyboard tones, the pedal keyboard tones and the automatic arpeggio tones and each of the key codes representing the respective tones is assigned to its proper exclusive channel.

Description will first be made about assignment in the channel processor section 60*a* of the key codes representing the depressed keys and the key codes for the automatic bass/chord performance. A key code memory circuit 61 in the channel processor section 60*b* is composed, for example, of an 18-stage/7-bit shift register having eighteen storage positions corresponding to the eighteen tone production channels. The key code memory circuit 61 assigns the key code KC ($B_3$-$N_1$) supplied from the key coder section 60*a* to a corresponding one of the exclusive channels and stores it in a time shared fashion. The assignment of the key code to the respective storage positions in the key code memory circuit 61 is controlled by an assignment control section 64.

The assignment control section 64 produces a load signal LD for controlling loading timings in the key code memory circuit 61 in response to the signals U,L and P applied from the key coder 60*a* and indicating which keyboard the key code being presently applied to the key code memory circuit 61 belongs to and also in response to the output of a key code comparison circuit 63 which compares the key code KC($B_3$-$N_1$) being applied to the key code memory circuit 61 with the key code KC($B_3$-$N_1$) which has already been assigned to the storage positions of the key code memory circuit 61.

Accordingly, the assignment control section 64 supplies the load signal LD to the key code memory circuit 61 for a new tone production assignment operation if all of the following conditions are satisfied;

(1) The key code $KC(B_3\text{-}N_1)$ is presently being applied;
(2) This key code has not been assigned to any of the exclusive channels available for this key code; and
(3) There is an empty one among the exclusive channels available for this key code.

A truncate circuit 66 is a circuit for detecting a channel to which the key code representing the key which has been released earlier than any other released keys is assigned from among the key codes stored in the key code memory circuit 61. The truncate circuit 66 produces a truncate channel designation signal TR upon detection of such key code, supplying the signal TR to the assignment control section 64. Upon receipt of the signal TR, the assignment control section 64 cancels the contents stored in the channel which is designated by the signal TR for assignment of a newly applied key code KC.

A key-on signal generation circuit 65 generates three kinds of key-on signals $KO_1$, $KO_2$ and $KO_3$ in accordance with the assignment control performed by the assignment control section 64. The key-on signal $KO_1$ is a signal corresponding to the on-off of the key which is "1" for the period from the application of the key code (i.e. from a time point at which the key code KC is stored in the key code memory circuit 61) till detection of the key-off by the key-off detection signal X which is applied to the assignment control section 64 at a predetermined time interval. The key-on signal $KO_2$ is a signal obtained by differentiating the key-on signal $KO_1$ and maintains a level "1" only during about 5 ms at the key-on time. The key-on signal $KO_3$ is used for producing an attack waveform and maintains a level "1" during about 30 ms at the key-on time, which is slightly longer than the key-on signal $KO_2$.

An automatic arpeggio circuit 62 sequentially produces key codes representing automatic arpeggio tones in response to the key codes KC which have already been assigned to the respective tone production channels, i.e., the key codes KC which have been stored in the storage positions of the key code memory circuit 61 corresponding to the respective tone production channels. The automatic arpeggio circuit 62, which is not illustrated in detail, can produce key codes representing automatic arpeggio tones consisting of three tones which are determined by the arpeggio pattern signals $AP_1$–$AP_3$ applied from the pattern generator 70 (FIG. 1) and an up/turn signal UT applied through the key coder section 60*a* and representing the mode of the arpeggio performance. These key codes representing the three arpeggio tones are produced while the automatic arpeggio signals $ARP_1$–$ARP_3$ are produced by the key coder 60*a*. The key codes representing the automatic arpeggio tones generated by the automatic arpeggio circuit 62 are applied to the key code memory circuit 61 through a key code bus. The assignment control section 64 produces the load signal LD at timings corresponding to the channels allotted exclusively to the arpeggio performance and in response to the automatic arpeggio signals $ARP_1$–$ARP_3$ generated by the key coder 60*a* and to the comparison output of the key code comparison circuit 63, and thereby controls assignment of the key codes representing the automatic arpeggio tones to the channels allotted exclusively to the arpeggio tones. While the automatic arpeggio signals $ARP_1$–$ARP_3$ are applied from the key coder 60*a* to the assignment control section 64, delivering of the key codes KC from the key coder 60*a* is interrupted and the assignment of the automatic arpeggio tones generated by the automatic arpeggio circuit 62 only is effected.

The assignment control section 64 further produces a lower keyboard key-on signal LKON which represents that any one of the keys in the lower keyboard is being depressed. This signal LKON is a signal which becomes "1" if at least one of the lower keyboard keys has been assigned to one of the channels for the lower keyboard, and is formed based on the key-on signals $KO_1$. The lower keyboard key-on signal LKON is applied to a waiting time setting circuit 67 and a chord tone generation timing signal gate circuit 68 where it is used for setting of waiting time for the automatic arpeggio performance and also for generation of chord tone generation timing signals according to the present invention.

The waiting time for the automatic arpeggio performance is needed in the automatic arpeggio circuit 62 for the following reason. Processing for the automatic arpeggio performance is carried out in accordance with the key codes representing a plurality of keys depressed in the the lower keyboard. It is however, difficult to depress all of the keys exactly at a same time. If, therefore, the player intends to depress three keys simultaneously and two keys have actually been depressed only slightly before the third key, the processing for the automatic arpeggio performance is carried out. Accordingly, in the present embodiment, waiting time of 14 ms is provided and an automatic arpeggio start signal ST is supplied to the automatic arpeggio circuit 62 after the lapse of this waiting time counting from the time when the first one of the keys for arpeggio performance is depressed in the lower keyboard so that the processing in the automatic arpeggio circuit 62 is started upon receipt of the start signal ST.

The chord tone generation timing signal gate circuit 68 includes gate circuits and gates out chord tone generation timing signal ACI-ACII generated by the pattern generator 70 and applied through the key coder 60*a* when the lower keyboard key-on signal LKON is being produced.

Figure 3:
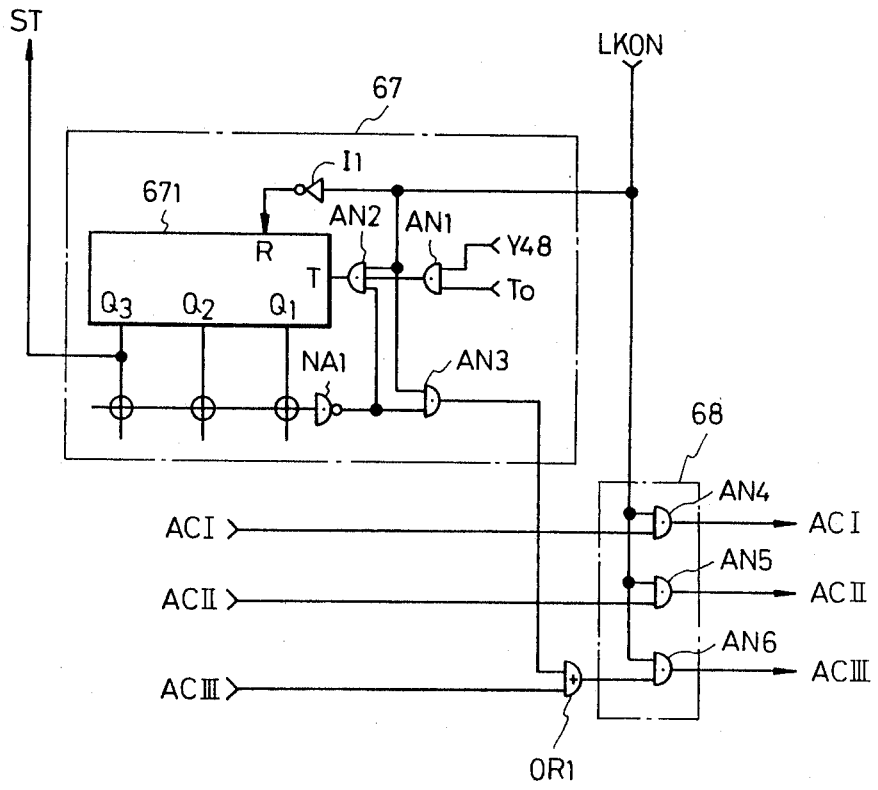
FIG. 3 is a circuit diagram showing in detail examples of a waiting time setting circuit and a chord tone generation timing signal gate circuit shown in FIG. 2.

Examples of the waiting time setting circuit 67 and the chord tone generation timing signal gate circuit 68 are shown in FIG. 3. The waiting time setting circuit 67 is composed of a 3-bit counter 671. When the lower keyboard key-on signal LKON is not produced, the counter 671 is at its reset state by the output ("1") of an inverter $I_1$. When the lower keyboard key-on signal LKON is produced, the signal applied to a reset terminal R of the counter 671 through the inverter $I_1$ becomes "0" and the counter 671 thereby is enabled. To the count input T of the counter 671 is applied, through an AND gate $AN_2$ the output of an AND gate $AN_1$ which is enabled by application thereto of a signal $T_0$ with a pulse width of 54 microseconds and a period of 3.5 ms and a signal $Y_{48}$. The signal $Y_{48}$ is a signal with a pulse width of 1 microsecond synchronized with the timing of operation of the automatic arpeggio circuit 62, though detailed description thereof is omitted. To the other input of the AND gate $AN_2$ is applied an output of a NAND gate $NA_1$ which is enabled by application thereto of the lower keyboard key-on signal LKON and outputs the respective bits $Q_3$, $Q_2$, $Q_1$ of the counter 671. Since the bit outputs $Q_3$-$Q_1$ of the counter 671 are all "0" when the lower keyboard key-on signal LKON is produced, the counter 671 starts counting of the pulse signal with the pulse width of 1 microsecond and the period of 3.5 ms supplied from the the AND gate $AN_1$ immediately upon generation of the lower keyboard key-on signal LKON. When the count value $Q_3$-$Q_1$ of the counter 671 has reached "100", i.e. time of 3.5 ms×4=14 ms has elapsed, the automatic arpeggio processing start signal ST is produced from the most significant bit output $Q_3$.

Besides the above described operation, the waiting time setting circuit 67 produces a pulse signal with a pulse width of 24.5 ms synchronized with rise of the lower keyboard key-on signal LKON by differentiating the signal LKON. The lower keyboard key-on signal LKON and the output of the NAND gate $NA_1$ are applied to an AND gate $AN_3$. The output of the NAND gate $NA_1$ is "1" when the counter 671 is at its reset state and becomes "0" when the count value $Q_3$-$Q_1$ of the counter 671 has reached "111" by generation of the lower keyboard key-on signal LKON, i.e. when 3.5 ms×7=24.5 ms has elapsed. Accordingly, the AND gate $AN_3$ produces a differentiated pulse of 24.5 ms synchronized with the rise of the lower keyboard key-on signal LKON. Upon turning of the output of the NAND gate $NA_1$ to "0", the AND gate $AN_2$ is disabled and the count value $Q_3$-$Q_1$ is suspended at a value "111".

The differentiated signal of the lower keyboard key-on signal LKON outputted by the waiting time setting circuit 67 is combined through an OR gate $OR_1$ with a chord tone generation timing signal ACIII and thereafter is applied to the chord tone generation timing signal gate circuit 68. In this circuit 68, the differentiated signal of the lower keyboard key-on signal LKON is used for controlling the tone color of an "attack wow" to be generated at the start of key depression in the lower keyboard as will be described more fully later.

The chord tone generation timing signal gate circuit 68 is composed of AND gates $AN_4$, $AN_5$ and $AN_6$ which are enabled when the lower keyboard key-on signal LKON is present. The gate circuit 68 gate-controls the chord tone generation timing signals ACI and ACII generated by the pattern generator 70 and applied through the key coder section 60*a* and also gate-controls the output of the OR gate $OR_1$ to which the chord tone generation timing signal ACIII and the differentiated signal of the lower keyboard key-on signal LKON are applied.

Description will now be made about the automatic chord performance tone generation patterns $AC_1$–$AC_3$ which are stored in the pattern generator 70 and are used for producing the chord tone generation timing signals ACI–ACIII. The automatic chord performance tone generation patterns serve to control the tone generation timings of the chord tones in the automatic chord performance. The automatic chord performance is conducted in accordance with a tone or tones of a key or keys depressed in the lower keyboard. More specifically, while a key or keys in the lower keyboard are kept depressed, chord tones produced on the basis of the key or keys in the lower keyboard are generated at predetermined timings so that the chord performance is conducted as if a plurality of keys had been newly depressed at the predetermined timing.

This automatic chord performance tone generation patterns are stored in the pattern generator 70 (FIG. 1) in accordance with the various rhythms and read out in synchronism with the rhythm pattern for forming a rhythm tone.

Figure 4:
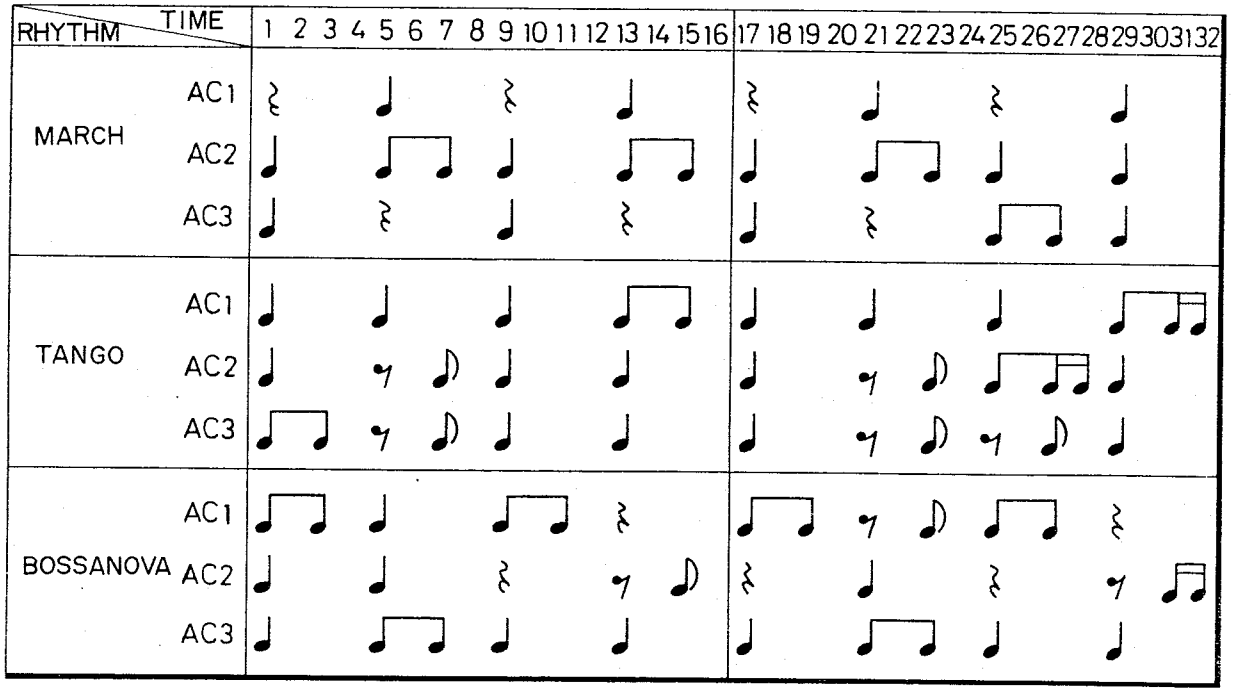
FIG. 4 is a musical rhythm notation showing examples of the automatic chord performance tone generation patterns stored in a pattern generator shown in FIG. 1.

FIG. 4 shows, as an example of the automatic chord performance tone generation patterns, three kinds of rhythm, i.e. march, tango and bossanova in musical notation each consisting of three series of the automatic chord performance tone generation patterns $ACP_1$–$ACP_3$ for two measures. The pattern generator 70 repeatedly produces the chord tone generation timing signals ACI–ACIII in accordance with the patterns $ACP_1$–$ACP_3$ as shown in FIG. 4 in the form of digital signals corresponding to the respective time slots (32 time slots in the present embodiment). If, for example, march is selected, pulses of a predetermined pulse width are generated at the fifth, thirteenth, twenty-first and twenty-ninth time slots as the chord tone generation timing signal ACI corresponding to the first automatic chord performance tone generation pattern $ACP_1$, pulses of a predetermined pulse width are generated at the first, fifth, seventh, ninth, thirteenth, fifteenth, seventeenth, twenty-first, twenty-third, twenty-fifth and twenty-ninth time slots as the chord tone generation timing signal ACII corresponding to the second automatic chord performance tone generation pattern $ACP_2$, and pulses of a predetermined pulse width are generated at the first, ninth, seventeenth, twenty-fifth, twenty-seventh and twenty-ninth time slots as the chord tone generation timing signal ACIII corresponding to the third automatic chord performance tone generation pattern $ACP_3$, the pattern generator 70 repeating the above described operation. The width of the above described time slots is suitably determined according to the selected kind of rhythm or tempo.

The key codes assigned and stored in the respective storage positions (i.e. respective channels) of the key code memory circuit 61, the key-on signals $KO_1$–$KO_3$ generated by the key-on signal generation circuit 65, the three series of chord tone generation timing signals ACI–ACIII generated by the chord tone generation timing signal gate circuit 68 and the accent signal ACC, ballade selection signal BL and slow rock signal SR generated by the key coder section 60*a* in response to the signal from the pattern generator 70 are all applied to a data multiplexing circuit 69 where these signals are multiplexed in time division into 4-bit digital code signals (time division multiplexed data) $KC_4$, $KC_3$, $KC_2$, $KC_1$ and thereafter are supplied to a tone generator 80 (FIG. 1).

The relationship between the various data KC, $KO_1$–$KO_3$, ACI–ACIII, ACC, BL and SR which are time division multiplexed by the data multiplexing circuit 69 (details thereof is not shown) and the digital code signal $KC_4$-$KC_1$ is shown in FIG. 5. As the digital code signal $KC_4$-$KC_1$, a signal "1111" representing the head (leading portion) of the data is outputted at the first time slot. At the second time slot, the block code bits $B_1$–$B_3$ of the pedal keyboard tone assigned to the first channel is outputted for the signal bits $KC_1$–$KC_3$ and the key-on signal $KO_1$ is outputted for the signal bit $KC_4$. At the third time slot, the note code bits $N_1$–$N_4$ is outputted for the signal bits $KC_1$–$KC_4$. Throughout the fourth to the twentyfourth time slots, data (i.e. bit states $B_1$–$B_3$, $N_1$–$N_4$ and $KO_1$–$KO_3$) relating to the upper keyboard tones assigned to the fourth, seventh, tenth, thirteenth, sixteenth, second and fifth channels is outputted, data for each channel (i.e. data for one upper keyboard tone) being divided into three groups and sequencially outputted at three time slots. For example, data of the upper keyboard tones assigned to the fourth channel is outputted at the fourth through sixth time slots. More specifically, the key-on signal $KO_2$ and $KO_3$ are outputted for the signals $KC_1$ and $KC_4$ at the fourth time slot, the block code bits $B_1$–$B_3$ of the upper keyboard tone assigned to the fourth channel for the signals $KC_1$–$KC_3$ and the key-on signal $KO_1$ for the signal $KC_4$ at the fifth time slot, and the note code bits $N_1$–$N_4$ of the upper keyboard tone for the signals $KC_1$–$KC_4$ at the sixth time slot. Likewise, data of upper keyboard tones assigned to the seventh, tenth, thirteenth, sixteenth, second and fifth channels are outputted respectively at the seventh to ninth times slots, the tenth to twelfth time slots, the thirteenth to fifteenth time slots, the sixteenth to eighteenth time slots, the nineteenth to twenty-first time slots and the twenty-second to twenty-fourth time slots.

Data of lower keyboard tones is outputted at the twenty-fifth to forty-fifth time slots. More specifically, data of lower keyboard tones assigned to the eight, eleventh, fourteenth, seventeenth, third, sixth and ninth channels is outputted respectively at the twenty-fifth to twenty-seventh time slots, the twenty-eight to thirtieth time slots, the thirty-first to thirty-third time slots, the thirty-fourth to thirty-sixth time slots, the thirty-seventh to thirty-ninth time slots, the fourtieth to forty-second time slots and the forty-third to forty-fifth time slots. Data of the automatic arpeggio tones and data of the automatic chord performance relating to the present invention is outputted at the forty-sixth to fifty-fourth time slots. More specifically, the key-on signal $KO_2$ for the automatic arpeggio tone assigned to the twelfth channel, the slow rock selection signal SR and the ballade selection signal BL are outputted for the signals $KC_1$–$KC_3$ at the forty-sixth time slot. The block code bits $B_1$–$B_3$ of this automatic arpeggio tone is outputted for the signals $KC_1$–$KC_3$ and the accent signal ACC for the signal $K_4$ at the forty-seventh time slot. The note code bits $N_1$–$N_4$ of the automatic arpeggio tone is outputted for the signals $KC_1$–$KC_4$ at the forty-eight time slot. The key-on signal $KO_2$ for the automatic arpeggio tone assigned to the fifteenth channel and the chord tone generation timing signals ACI and ACII are outputted for the signals $KC_1$–$KC_3$ at the forty-ninth time slot. The block code bits $B_1$–$B_3$ of this automatic arpeggio tone is outputted for the signals $KC_1$–$KC_3$ and the chord tone generation timing signal ACIII for the signal $KC_4$ at the fiftieth time slot. The note code bits $N_1$–$N_4$ of the automatic arpeggio tone is outputted for the signals $KC_1$–$KC_4$ at the fifty-first time slot. Data of the automatic arpeggio tone assigned to the eighteenth channel is outputted at the fifty-second to fifty-fourth time slots. The key-on signal $KO_2$ is outputted for the signal $KC_1$ at the fifty-second time slot. The block code bits $B_1$–$B_3$ is outputted for the signals $KC_1$–$KC_3$ at the fifty-third time slot. The note code bits $N_1$–$N_4$ is outputted for the signals $KC_1$–$KC_4$ at the fifty-fourth time slot. As will be apparent from the above description, in the present embodiment of the applicant's invention, the first channel is used exclusively for the pedal keyboard tones, the fourth, seventh, tenth, thirteenth, sixteenth, second and fifth channels for the upper keyboard tones, the eighth, eleventh, fourteenth, seventeenth, third, sixth and ninth channels for the lower keyboard tones and the twelfth, fifteenth and eighteenth channels for the automatic arpeggio tones. Each time slot may have a suitable time length, e.g. 1 microsecond as in the present embodiment. Contents of the signals $KC_1$–$KC_4$ change every microsecond as shown in FIG. 5.

The function switch section 40 (FIG. 1) includes function switches for controlling envelopes of upper and lower keyboard tones, an orchestra response selection switch, an upper keyboard tone damping selection switch, a lower keyboard tone damping selection switch, an upper keyboard tone decay length setting switch and a lower keyboard tone decay length setting switch. States of operation of these various function switches are detected by the function switch detector 50.

Figure 6:
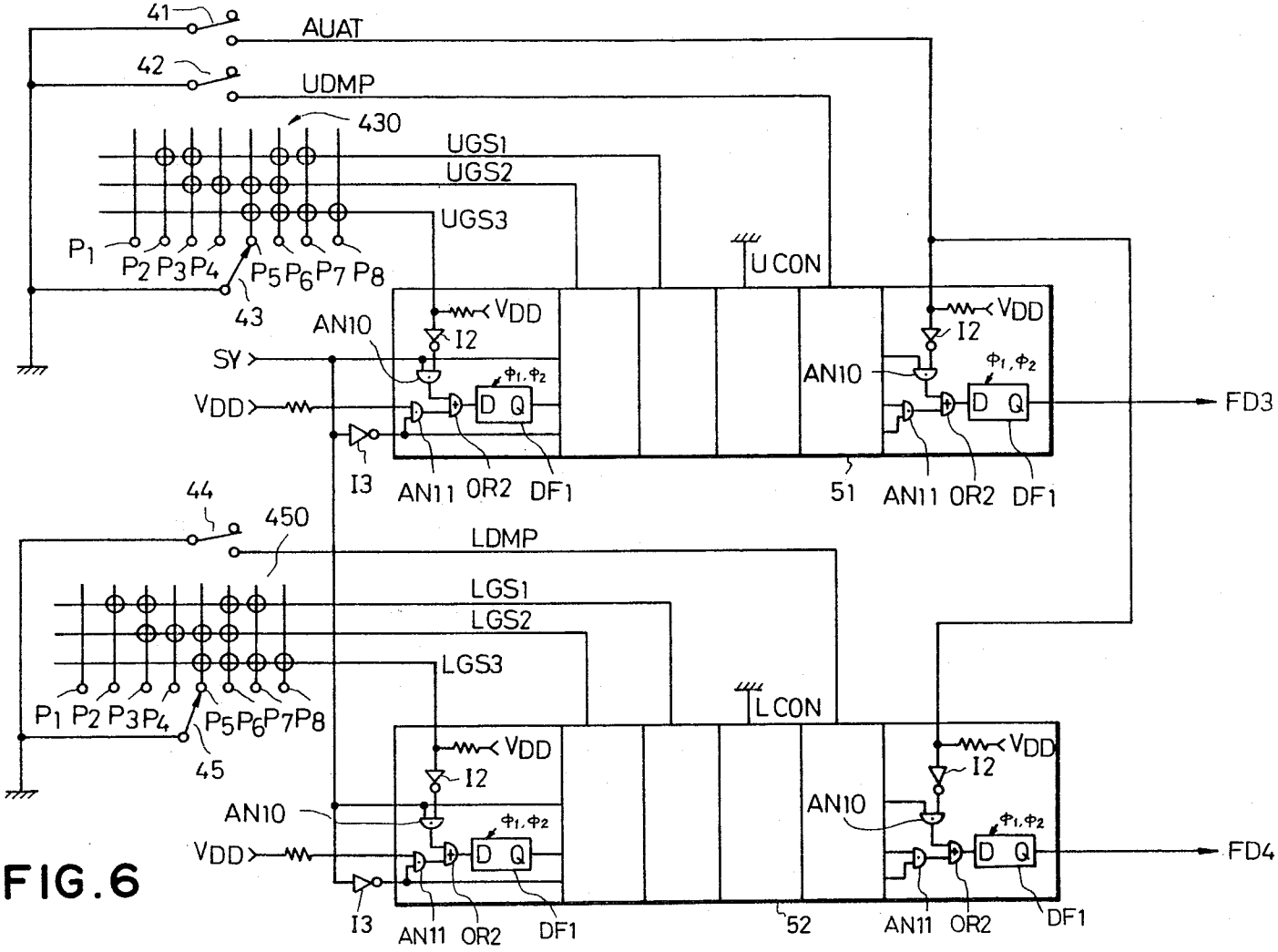
FIG. 6 is a circuit diagram showing examples of a function switch section 40 and a function switch detector 50 shown in FIG. 1.

FIG. 6 shows an example each of the function switch section 40 and the function switch detector 50 in detail. For simplification, function switches for controlling envelopes of orchestra tones and the automatic bass/chord tones only are shown in FIG. 6 and function switches for controlling envelopes of flute tones are not shown. However, the function switch section 40 actually includes function switches for controlling the envelopes of the flute tones. Accordingly, function switch detection circuit 51 and 52 for detecting function switches for the upper and lower keyboard tones actually are composed of circuits having more stages than those shown in the figure.

An upper keyboard tone decay length setting switch 43 and a lower keyboard tone decay length setting switch 45 are provided respectively for setting the decay length of the upper keyboard tones and lower keyboard tones. The upper keyboard tone decay length setting switch 43 sets the decay length of the upper keyboard tones by switching contacts $P_1$–$P_8$ of an upper keyboard tone decay length setting circuit 430. As will become apparent from description to be made later, the decay length decreases by setting the switch to the contact $P_8$ side and increases by setting the switch to the contact $P_1$ side. The upper keyboard tone decay length setting circuit 430 produces 3-bit data $UGS_3$, $UGS_2$, $UGS_1$ in response to this switching of the upper keyboard tone decay length setting switch 43. Relation between the contacts $P_1$–$P_8$ and the data bits $UGS_1$–$UGS_3$ is shown in the following Table 3:

TABLE 3

| | $UGS_1$ | $UGS_2$ | $UGS_3$ |
|---|---|---|---|
| $P_1$ | 0 | 0 | 0 |
| $P_2$ | 1 | 0 | 0 |
| $P_3$ | 1 | 1 | 0 |
| $P_4$ | 0 | 1 | 0 |
| $P_5$ | 0 | 1 | 1 |
| $P_6$ | 1 | 1 | 1 |
| $P_7$ | 1 | 0 | 1 |
| $P_8$ | 0 | 0 | 1 |

A lower keyboard tone decay length setting circuit 45 likewise switches contacts $P_1$–$P_8$ of a lower keyboard tone decay length setting circuit 450 and the circuit 450 thereupon produces 3-bit data $LGS_3$, $LGS_2$, $LGS_1$ representing the sustain length of the lower keyboard tones. The data bits $UGS_1$–$UGS_3$ for the decay length of the upper keyboard tones outputted by the upper keyboard tone decay length setting circuit 430 and the data bits $LGS_1$–$LGS_3$ for the decay length of the lower keyboard tones outputted by the lower keyboard tone decay length setting circuit 450 is respectively applied to the first to third stages of an upper keyboard tone function switch detection circuit 51 and those of a lower keyboard tone function switch detection circuit 52.

An upper keyboard tone damping selection switch 42 and a lower keyboard tone damping selection switch 44 are provided for operation when a damping effect is desired with respect to the upper and lower keyboard tones. An orchestra response selection switch 41 is provided for imparting an attack effect (an effect of sharpening rise of a tone) to the upper and lower keyboard tones. An upper keyboard tone damp signal UDMP outputted by the upper keyboard tone damping selection switch 43 and a lower keyboard tone damp signal LDMP outputted by the lower keyboard tone damping selection switch 44 are respectively applied to the fifth stages of the upper keyboard tone function switch detection circuit 51 and the lower keyboard tone function switch detection circuit 52. An orchestra attack signal AUAT outputted by the orchestra response selection switch 41 is applied to final stages (the sixth stages) of the upper keyboard tone function switch detection circuit 51 and the lower keyboard tone function switch detection circuit 51. Inputs of the fourth stages of the detection circuits 51 and 52 correspond to signals UCON, and LCON which respectively instruct that the upper and lower keyboard tones be imparted with a sustained (continued) envelope. In the present embodiment, however, the upper and lower keyboard tones are always imparted with sustained envelope and, accordingly, the inputs of the fourth stages are grounded.

Each of the upper keyboard tone function switch detection circuit 51 and the lower keyboard tone function switch detection circuit 52 comprises, as shown representively by the first and final (sixth) stages thereof, an inverter $I_2$ for inverting an input signal, an AND gate $AN_{10}$ for controlling loading of the input signal, an AND gate $AN_{11}$ for shift control, and OR gate $OR_2$ and a delay flip-flop $DF_1$ and controls loading of the applied signals and converting thereof to serial data. The input signal loading control AND gate $AN_{10}$ of the detection circuits 51 and 52 receives the synchronizing signal SY at a control input thereof. The synchronizing signal SY is a signal synchronized with the timing at which the signal $KC_1$–$KC_4$ outputted by the data multiplexing circuit 69 of the key assigner 60 becomes "1111" (i.e. the first time slot in FIG. 5) which represents the head of the data. Accordingly, in the detection circuits 51 and 52, the above described data $UGS_3$-$UGS_1$, $LGS_3$-$LGS_1$, UDMP, LDMP and AUAT is inverted by the inverter $I_2$ at the timing of the synchronizing signal SY and loaded in the delay flip-flop $DF_1$ through the AND gate $AN_{10}$ and the OR gate $OR_2$. The outputs of the first through fifth stages of the upper keyboard tone function switch detection circuit 51 and the lower keyboard tone function switch detection circuit 52 are respectively inputted to the shift control AND gate $AN_{11}$ of a next stage (i.e. the second to sixth stages). A signal $\overline{SY}$ obtained by inverting the synchronizing signal SY by an inverter $I_3$ is applied commonly to the shift control AND gates $AN_{11}$ of the respective stages. Accordingly, upon turning of the synchronizing signal SY to "0", the shift control AND gate $AN_{11}$ of the respective stages are enabled and the data loaded in the delay flip-flops $DF_1$ of the first through fifth stages is inputted to the delay flip-flops $DF_1$ of the next stages (the second through sixth stages). Each of the delay flip-flops $DF_1$ is driven by a two phase clock $\phi_1$, $\phi_2$ with a period of 1 microsecond (clock $\phi_1$ assumes a state "1" in the first half of 1 microsecond and clock $\phi_2$ assumes a state "1" in the second half of 1 microsecond). The data in each stage therefore is shifted sequentially every 1 microsecond. Accordingly, after storing the data applied in synchronism with the synchronizing signal SY, the upper keyboard tone function switch detection circuit 51 and the lower keyboard tone function switch detection circuit 52 sequentially shift the stored data from a next timing and delivers out serial function data $FD_3$ and $FD_4$. The function data $FD_3$ and $FD_4$ outputted by the function switch detector 50 is applied to the tone generator 80.

The tone generator 80 produces, in response to the time division multiplexed data $KC_4$-$KC_1$ supplied by the key assigner 60 and representing tones to be generated and to the function data $FD_3$ and $FD_4$ supplied by the function switch detector 50, tone signals UK upper keyboard tones, tone signals LK for lower keyboard tones, tone signal PK for pedal keyboard tones and tone signals $ACH_1$, $ACH_2$ and $ACH_3$ for the automatic chord tones all with an envelope being imparted.

Figure 7:
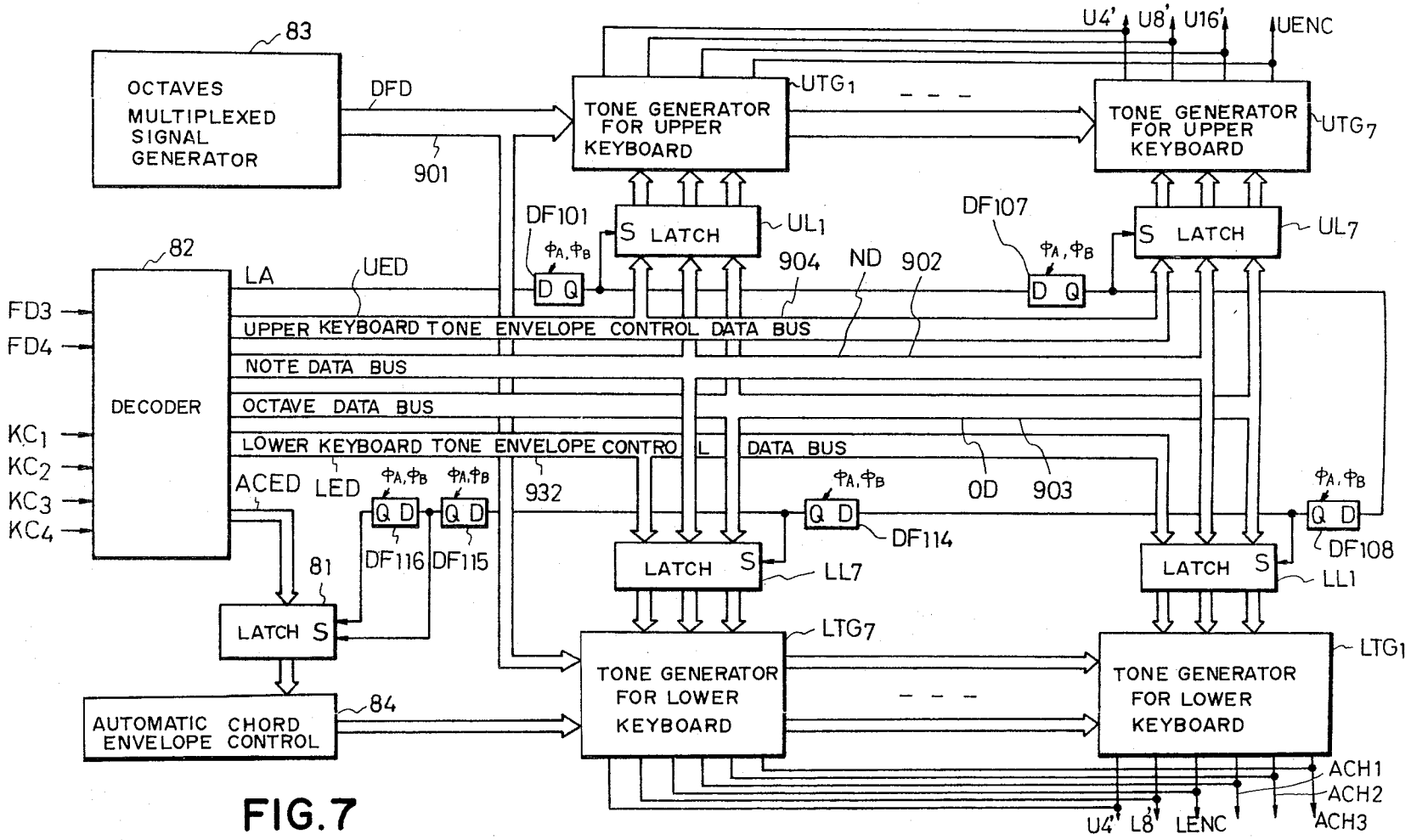
FIG. 7 is a block diagram showing an example of a tone generator shown in FIG. 1.

FIG. 7 shows an example of the tone generator 80. It should be noted that FIG. 7 shows a circuit for producing upper and lower keyboard tones of an orchestra tone system and automatic chord tones of three series and that upper and lower keyboard tones of a flute tone system, bass tones and arpeggio tones are produced by a separate circuit which is not shown.

A decoder 82 receives the time division data $KC_4$–$KC_1$ supplied from the key assigner 60 and the function data $FD_3$ and $FD_4$ supplied from the function switch detector 50 and thereupon decodes the time division data $KC_4$–$KC_1$ into note data ND and octave data OD corresponding to each tone and also decodes the function data $FD_3$ and $FD_4$ into upper keyboard tone envelope control data UED, lower keyboard tone envelope control data LED and automatic chord tone envelope control data ACED. Since the time division data $KC_4$–$KC_1$ for one tone (i.e. one channel) is delivered by three time slots as shown in FIG. 5, data at each time slot is suitably delayed to chronologically align the data in decoding of the data $KC_4$–$KC_1$. Then data for one tone (one channel) is taken out in parallel by latching the data every three bit times (3 microseconds) and this taken out data is decoded into the note data ND, octave data OD and automatic envelope control data ACED. In decoding the function data $FD_3$ and $FD_4$, the serial function data $FD_3$ and $FD_4$ is first converted to parallel data and then is decoded into the upper keyboard tone envelope control data UED($US_1$–$US_5$, UFA and USA) and the lower keyboard tone envelope control data LED ($LS_1$–$LS_5$, LAF and LSA).

Figure 8:
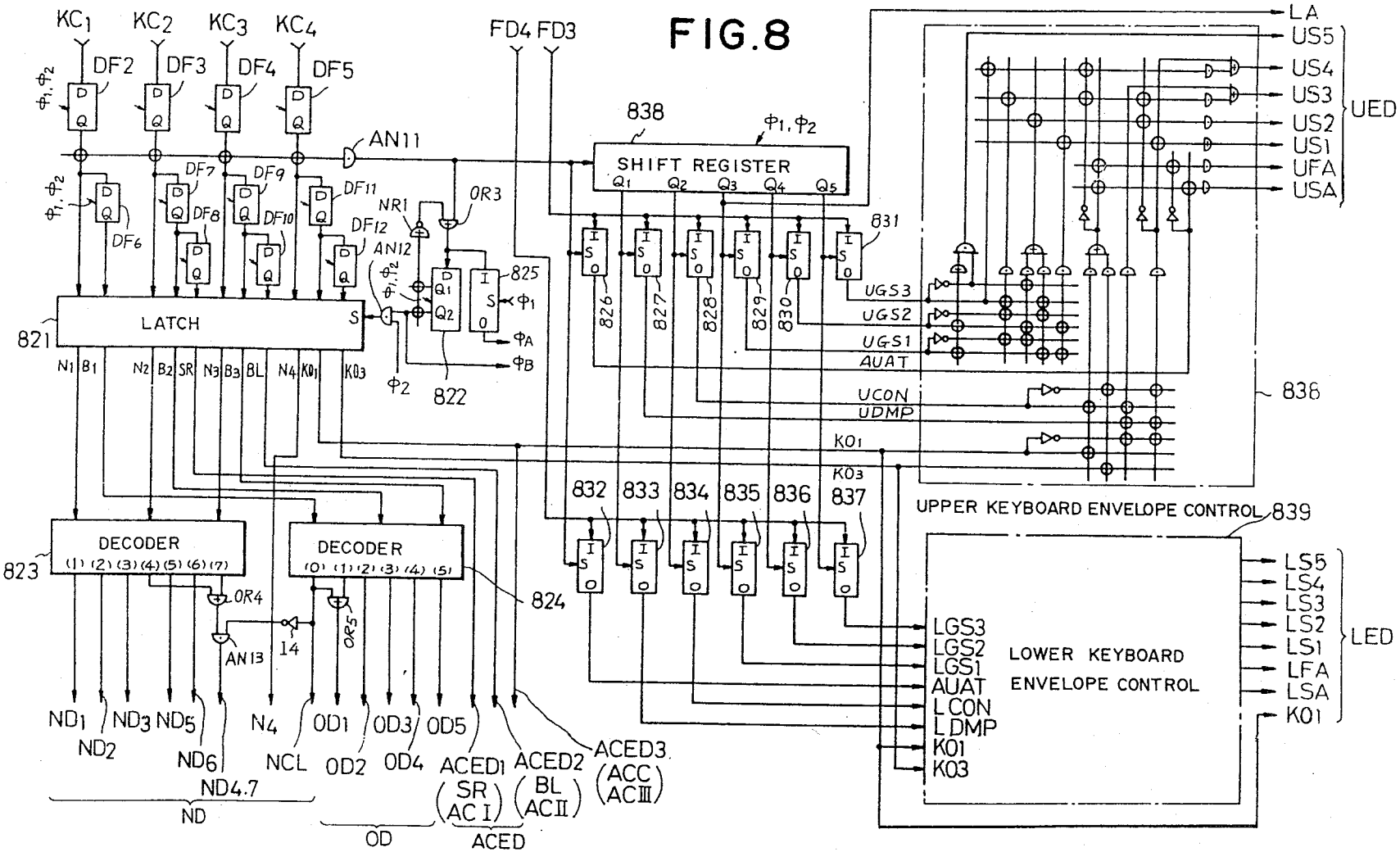
FIG. 8 is a circuit diagram showing a decoder shown in FIG. 7 in detail.

FIG. 8 shows an example of the decoder 82 in detail. The time division data bits $KC_1$–$KC_4$ supplied from the key assigner 60 is applied to delay flip-flops $DF_2$–$DF_5$. Outputs of the delay flip-flops $DF_2$–$DF_5$ are supplied directly to a latch circuit 821 and also to a latch circuit 821 after being delayed by delay flip-flops $DF_6$–$DF_{12}$ by 1 bit time (1 microsecond) or 2 bit time (2 microseconds). The delay flip-flops $DF_6$–$DF_{12}$ function to chronologically align data for one tone (one channel) allotted to three time slots.

Outputs of the delay flip-flops $DF_2$–$DF_5$ are applied to the AND gate $AN_{11}$. Since the time division data $KC_1$–$KC_4$ exhibits the state "1111" representing the head of data as shown in FIG. 5, the AND gate $AN_{11}$ is enabled at this timing, delivering a signal "1" to a two bit delay circuit 822 through an OR gate $OR_3$. Accordingly, a signal "1" appears at an output $Q_2$ of the two bit delay circuit 822 with a delay of 2 bit s from the timing at which the signal "1111" appears at the outputs of the delay flip-flops $DF_2$–$DF_4$. This signal "1" is applied to a strobe terminal S of a latch circuit 821 through an AND gate $An_{12}$ to which the clock pulse $\phi_2$ is applied as a gate signal.

In the above described manner, to the latch circuit 821 is first loaded data of the pedal tones assigned to the first channel. The three bits $N_1$–$N_3$ counting from the least significant bit of the note code $N_1$–$N_4$ in the loaded data are applied to a decoder 823 and the block code $B_1$–$B_3$ is applied to a decoder 824 respectively for decoding. Outputs (1), (2), (3), (5) and (6) of the decoder 823, an output of an AND gate $AN_{13}$ which is enabled by a signal obtained by combining outputs (4) and (7) of the decoder 823 by an OR gate $OR_4$ and a signal obtained by inverting an output (0) of the decoder 824 by an inverter $I_4$, an output of the latch circuit 821 corresponding to the delay flip-flop $DF_5$ and the output (0) of the decoder 824 are delivered out as note data ND($ND_1$, $ND_2$, $ND_3$, $ND_5$, $ND_{4.7}$, $ND_4$ and NCL). A signal obtained by combining the outputs (0) and (1) of the decoder 824 and outputs (2) through (5) of the decoder 824 are delivered out as octave data OD($OD_1$–$OD_5$). This data for the pedal keyboard tones, however, is not used in this circuit.

As a signal "1" has been outputted from the output $Q_2$ of the two bit delay circuit 822 and both outputs of one bit time delay outputs $Q_1$ and $Q_2$ have become "0" at a next timing, an output of a NOR gate $NR_1$ is turned to "1". This signal "1" is aaplied to the two bit delay circuit 822 and a signal "1" is produced from the output $Q_2$ after delay of 2 bit time. Thus, the two bit delay circuit 822 produces a signal "1" from the output $Q_2$ after delaying of 3 bit time from preceding production of signal "1", i.e. at the timing of time slots 3, 6, 9, 12, 15, 18, 21, 24, 27, 30, 33, 36, 39, 42, 45, 48, 51 and 54 of the time division data $KC_1$–$KC_4$. By this signal "1", data of an upper keyboard tone which has been assigned to the fourth channel is loaded in the latch circuit 821. In this manner, data which has been chronologically aligned for one tone (one channel) is loaded in the latch circuit 821 every 3 bit time in response to the signal "1" from the output $Q_2$ of the two bit delay circuit 822. This loaded data is delivered out through the decoders 823 and 824 as the note data ND ($ND_1$, $ND_2$, $ND_3$, $ND_5$, $ND_6$, $ND_{4.7}$, $N_4$ and NCL) and the octave data OD ($OD_1$–$OD_5$). Relation between the note code $N_1$–$N_4$ and the note data ND and relation between the block code $B_1$–$B_3$ and the octave data OD are shown in the following Tables 4 and 5:

TABLE 4

| $N_4$ | $N_3$ | $N_2$ | $N_1$ | Output of decoder 823 | ND | | | | | | |
|---|---|---|---|---|---|---|---|---|---|---|---|
| | | | | | $ND_1$ | $ND_2$ | $ND_3$ | $ND_5$ | $ND_6$ | $ND_{4.7}$ | $ND_4$ |
| 0 | 0 | 0 | 1 | (1) | 1 | 0 | 0 | 0 | 0 | 0 | 0 |
| 0 | 0 | 1 | 0 | (2) | 0 | 1 | 0 | 0 | 0 | 0 | 0 |
| 0 | 0 | 1 | 1 | (3) | 0 | 0 | 1 | 0 | 0 | 0 | 0 |
| 0 | 1 | 0 | 1 | (5) | 0 | 0 | 0 | 1 | 0 | 0 | 0 |
| 0 | 1 | 1 | 0 | (6) | 0 | 0 | 0 | 0 | 1 | 0 | 0 |
| 0 | 1 | 1 | 1 | (7) | 0 | 0 | 0 | 0 | 0 | 1 | 0 |
| 1 | 0 | 0 | 1 | (1) | 1 | 0 | 0 | 0 | 0 | 0 | 1 |
| 1 | 0 | 1 | 0 | (2) | 0 | 1 | 0 | 0 | 0 | 0 | 1 |
| 1 | 0 | 1 | 1 | (3) | 0 | 0 | 1 | 0 | 0 | 0 | 1 |
| 1 | 1 | 0 | 1 | (5) | 0 | 0 | 0 | 1 | 0 | 0 | 1 |
| 1 | 1 | 1 | 0 | (6) | 0 | 0 | 0 | 0 | 1 | 0 | 1 |
| 1 | 1 | 0 | 0 | (7) | 0 | 0 | 0 | 0 | 0 | 1 | 1 |

TABLE 5

| $B_3$ | $B_2$ | $B_1$ | Output of decoder 824 | $OD_1$ | $OD_2$ | $OD_3$ | $OD_4$ | $OD_5$ |
|---|---|---|---|---|---|---|---|---|
| 0 | 0 | 0 | (0) | 1 | 0 | 0 | 0 | 0 |
| 0 | 0 | 1 | (1) | 1 | 0 | 0 | 0 | 0 |

TABLE 5-continued

| $B_3$ | $B_2$ | $B_1$ | Output of decoder 824 | $OD_1$ | $OD_2$ | $OD_3$ | $OD_4$ | $OD_5$ |
|---|---|---|---|---|---|---|---|---|
| 0 | 1 | 0 | (2) | 0 | 1 | 0 | 0 | 0 |
| 0 | 1 | 1 | (3) | 0 | 0 | 1 | 0 | 0 |
| 1 | 0 | 0 | (4) | 0 | 0 | 0 | 1 | 0 |
| 1 | 0 | 1 | (5) | 0 | 0 | 0 | 0 | 1 |

When the block code $B_3$–$B_1$ is a signal "000", the signal NCL is produced as the note data ND. This disables the AND gate $AN_{13}$ so that the signal $ND_{4.7}$ is inhibited.

The key-on signals $KO_1$ and $KO_3$ corresponding to the time division data $KC_4$ are also delivered from the latch circuit 821. Since a 2 bit delay signal outputted from the delay flip-flop $DF_2$ to which the time division data $KC_1$ is applied is not applied to the latch circuit 821, the key-on signal $KO_2$ is not latched by the latch circuit 821. This is because the key-on signal $KO_2$ is not employed in this circuit.

The time division data $KC_1$–$KC_4$ at the forty-sixth through fifty-fourth slots contains, in addition to the signals concerning the automatic arpeggio tones assigned to the twelfth, fifteenth and eighteenth channels, signals for envelope control of the automatic chord tones. More specifically, the time division data $KC_2$ and $KC_3$ at the forty-sixth time slot corresponding to the arpeggio tone assigned to the twelfth channel contains the slow rock selection signal SR and the ballade selection signal BL. The time division data bit $KC_4$ at the forty-seventh time slot contains the accent signal ACC. The time division data bits $KC_2$ and $KC_3$ at the forty-ninth time slot corresponding to the arpeggio tone assigned to the fifteenth channel contains the chord tone generation timing signals ACI and ACII. The time division data bit $KC_4$ at the fiftieth time slot contains the chord tone generation timing signal ACIII. These signals for controlling envelopes of the automatic chord tones are taken out of the outputs of the delay flip-flop $DF_8$, delay flip-flop $DF_{10}$ and delay flip-flop $DF_{11}$ of the latch circuit 821 and delivered as automatic chord tone envelope control data ACED ($ACED_1$–$ACED_3$). The signal $ACED_1$ contains the slow rock selection signal SR and the chord tone generation timing signal ACI, the signal $ACED_2$ contains the ballade selection signal BL and the chord tone generation timing signal ACII and the signal $ACED_3$ contains the accent signal ACC and the chord tone generation timing signal ACIII, respectively. The output signal of the OR gate $OR_3$ which constitutes an input signal to the two bit delay circuit 822 is applied to a latch 825 which receives the clock $\phi_1$ at its strobe terminal S. The output of this latch 825 and the output $O_2$ of the two bit delay circuit 822 are used as a two-phase clock pulse $\phi_A$, $\phi_B$ having a period of 3 microseconds used for driving delay flip-flops $DF_{101}$–$DF_{116}$ to be described later.

The function data $FD_3$ containing signals for controlling the envelope of the upper keyboard tones and being supplied by the function switch detector 50 (FIG. 6) is applied to latch 826–831. The function data $FD_4$ containing the signals for controlling the envelopes of the upper keyboard tones and being supplied also by the function switch detector 50 is applied to latches 832–837. Each of the latches 826–831 and 832–837 receives at its strobe terminal S the output of the AND gate $AN_{11}$ which produces a signal "1" when the signal "111" representing the head of the data appears at the output terminals of the delay flip-flops $DF_2$–$DF_5$. Each of the latches 826–831 and 832–837 also receives at the strobe terminal S parallel outputs $Q_1$–$Q_5$ of a shift register 838 which sequentially shifts the output signal "1" of the AND gate $AN_{11}$. Accordingly, the latch 826 latches the orchestra attack signal AUAT which is the first appearing data of the function data $FD_3$ in response to the output of the AND gate $AN_{11}$. The latch 827 latches the upper keyboard damp signal UDMP which is next data of the function data $FD_3$ in response to the output $Q_1$ of the shift register 838. The latches 828–831 likewise latch a signal UCON (constantly "1") designating that the upper keyboard tones should be provided with a sustained envelope and data $UGS_1$–$UGS_3$ representing the decaying length of the upper keyboard tones in response to the outputs $Q_2$–$Q_5$ of the shift register 838.

The latches 832–837 latch signals concerning the envelope control of the lower keyboard tones, i.e. the orchestra attack signal USAT, the lower keyboard tone damp signal LDMP, a signal LCON (constantly "1") which designates that the lower keyboard tones should be provided with a sustain envelope and the data $LGS_1$–$LGS_3$ representing the decay length of the lower keyboard tones, in response to the output of the AND gate $AN_{11}$ and the output $Q_1$–$Q_5$ of the shift register 838.

The signals (AUAT–$UGS_3$) concerning the envelope control of the upper keyboard tones latched by the latches 826–831 and the signals (USAT–$LGS_3$) concerning the envelope control of the lower keyboard tones latched by the latches 832–837 are respectively applied to an upper keyboard tone envelope control data forming circuit 838 and a lower keyboard tone envelope control data forming circuit 839.

The upper keyboard tone envelope control data forming circuit 838 produces upper keyboard tone envelope control data UED ($US_1$–$US_5$, UFA and USA) in accordance with the signals AUAT–$UGS_3$ concerning envelope control of the upper keyboard tones supplied from the latches 826–831 and the key-on signals $KO_1$, $KO_3$ supplied from the latch circuit 821. The operation of the upper keyboard tone envelope control data forming circuit 838 is expressed by the following logical formulas on the assumption that the signal UCON is constantly "1":

$$US_1 = UGS_1 \cdot UGS_2 \quad (1)$$

$$US_2 = \overline{UGS_1} \cdot UGS_2 \cdot \overline{UGS_3} + UGS_1 \cdot \overline{UGS_2} \cdot UGS_3 \quad (2)$$

$$US_3 = (\overline{UGS_1} \cdot \overline{UGS_2} \cdot UGS_3 + U\,DMP)\,\overline{KO_1} \quad (3)$$

$$US_4 = UGS_3 \cdot \overline{KO_1} \quad (4)$$

-continued $$US_5 = (UGS_1 + UGS_2)\,\overline{UGS_3} \quad (5)$$

$$UFA = KO_1 \cdot \overline{AUAT} \quad (6)$$

$$USA = KO_1 \cdot AUAT \quad (7)$$

If, for example, the key-on signal $KO_1$ is "0", i.e. no key is being depressed, and the signal UDMP is "0", ie.e the upper keyboard tone damping selection switch 42 (FIG. 6) is not in an "ON" state, relation between the data $UGS_1$–$UGS_3$ and the signals $US_1$–$US_5$ in shown in the following Table 6.

TABLE 6

| $UGS_1$ | $UGS_2$ | $UGS_3$ | $US_1$ | $US_2$ | $US_3$ | $US_4$ | $US_5$ |
|---|---|---|---|---|---|---|---|
| 0 | 0 | 0 | 0 | 0 | 0 | 0 | 0 |
| 1 | 0 | 0 | 0 | 0 | 0 | 0 | 1 |
| 1 | 1 | 0 | 1 | 0 | 0 | 0 | 1 |
| 0 | 1 | 0 | 0 | 1 | 0 | 0 | 1 |
| 0 | 1 | 1 | 0 | 0 | 0 | 1 | 0 |
| 1 | 1 | 1 | 1 | 0 | 0 | 1 | 0 |
| 1 | 0 | 1 | 0 | 1 | 0 | 1 | 0 |
| 0 | 0 | 1 | 0 | 0 | 1 | 1 | 0 |

If the signal $KO_1$ is "1", i.e. any key is being depressed, a signal $\overline{KO_1}$ is "0" so that the signals $US_3$ and $US_4$ are compulsorily turned to "0". If the signal UDMP is "1", i.e., the upper keyboard tone damping selection switch 42 (not shown) is in an "ON" state, the signal $US_3$ is compulsorily turned to "1" on the condition that no key is being depressed (i.e. the signal $KO_1$ is "0").

The signal UFA is a signal which appears when the signal $KO_1$ is "1" and the signal AUAT is "0" as shown in the above formula (6), i.e., any key is being depressed when the orchestra response selection switch 41 (FIG. 6) is at its "OFF" state.

The signal USA is a signal which appears when the signal $KO_1$ is "1" and the signal AUAT is "1", i.e. any key is being depressed when the orchestra response selection switch (FIG. 6) is at its "ON" state.

The signals $US_1$–$US_5$ are used for controlling the sustain length after release of the key (i.e. decay length) and the signals UFA and USA are used for controlling whether or not the attack effect should be imparted to the tones to be produced.

The lower keyboard tone envelope control data forming circuit 839, which is not illustrated in detail, is constructed in a manner similar to the upper keyboard tones envelope control data forming circuit 838.

The circuit 839 forms the signals $LS_1$–$LS_5$, IFA and LSA in accordance with the signals AUAT–$LGS_3$ concerning envelope control of the lower keyboard tones supplied from the key-on signals $KO_1$ and $KO_3$ supplied from the latch circuit 821 and outputting the signals $LS_1$–LSA and the key-on signal $KO_1$ provided by the latch circuit 821 as lower keyboard tone envelope control data LED.

An output $Q_3$ of the third stage of the shift register 838 is delivered out as a strobe signal LA which is used in latch circuits $UL_1$–$UL_7$, $LL_1$–$LL_7$ and 81 to be described below.

With reference to FIG. 7, upper keyboard tone generators $UTG_1$–$UTG_7$ and lower keyboard tone generators $LTG_1$–$LTG_7$ respectively correspond to the tone production channels of the key assigner 60 and, accordingly, generate tone signals corresponding to the tones assigned to the respective tone production channels. The upper keyboard tone envelope control data UED, note data ND and octave data OD generated by the decoder 82 in the above described manner is applied to latch circuits $UL_1$–$UL_7$ corresponding to the upper keyboard tone generators $UTG_1$–$UTG_7$. Likewise, the lower keyboard tone envelope control data LED, note data ND and octave data OD is applied to latch circuits $LL_1$–$LL_7$ corresponding to the lower keyboard tone generators $LTG_1$–$LTG_7$ and the automatic chord tone envelope control data ACED is applied to a latch circuit 81 corresponding to an automatic chord envelope control section 84 to be described later. To each strobe terminal S of the latch circuits $UL_1$–$UL_7$ and $LL_1$–$LL_7$ is applied a signal obtained by delaying a strobe signal LA outputted by the decoder 82 by delay flip-flops $DF_{101}$–$DF_{114}$ by 3 microseconds in each of them. To a strobe terminal S of the latch circuit 81 are applied two signals which are delayed by flip-flops $DF_{115}$ and $DF_{116}$ by 3 microseconds each. The delay flip-flops $DF_{101}$–$DF_{116}$ are driven by the clock pulses $\phi_A$, $\phi_B$ with a period of 3 microseconds $DF_{101}$–$DF_{116}$ are outputted after being delayed by 3 microseconds.

The signal applied to the strobe terminal S of the latch circuit $UL_1$ corresponding to the upper keyboard tone generator $UTG_1$ is a signal obtained by delaying the strobe signal LA outputted by the decoder 82 by the delay flip-flop $DF_{101}$ by 3 microseconds. Since the timing of the signal applied to the strobe terminal S of the latch circuit $UL_1$ is a timing of a signal obtained by delaying the output of the AND gate $AN_{11}$, which is enabled when the signal "1111" representing the heat of data appears in the outputs of the delay flip-flops $DF_2$–$DF_5$ of the decoder 82 (FIG. 8), by the shift register 838 by 3 bit time (3 microseconds) and further delaying the output of the shift register 838 by the delay flip-flop $DF_{101}$ by 3 bit time (3 microseconds), this timing is 6 bit time (6 microseconds) after appearance of the signal "1111" representing the head of data in the outputs of the delay flip-flops $DF_2$–$DF_5$, coinciding with the timing of the note data ND, and octave data OD and the upper keyboard tone envelope control data UED of the upper keyboard tone assigned to the fourth channel from the decoder 82 (see the table showing the time division data bits $KC_1$–$KC_4$ in FIG. 5). Accordingly, the note data ND, the octave data OD and the upper keyboard tone envelope control data UED for the upper keyboard tone assigned to the fourth channel is loaded in the latch circuit UL corresponding to the upper keyboard tone generator $UTG_1$. Likewise, the note data ND, the octave data OD and the upper keyboard tone envelope control data UED for the upper keyboard tones assigned to the seventh, tenth, thirteenth, sixteenth, second and fifth channels is loaded in the latch circuits $UL_2$–$UL_7$ corresponding to the upper keyboard tone generator $UTG_2$–$UTG_7$ whereas the note data ND, the octave data OD and the lower keyboard tone envelope control data LED for the lower keyboard tones assigned to the eighth, eleventh, fourteenth, seventeenth, third, sixth and ninth channels is loaded in the latch circuits $LL_1$–$LL_7$ corresponding to the lower keyboard tone generators $LTG_1$–$LTG_7$. The slow rock selection signal SR, the ballade selection signal BL and the accent signal ACC contained in the automatic chord tone envelope data ACED are loaded in the latch circuit 81 corresponding to the automatic chord envelope control section 84 at the timing of the output of the delay flip-flop $DF_{115}$. To the latch circuit 81 are also applied the chord tone generation timing signals ACI–ACIII contained in the automatic chord tone envelope data ACED at the timing of the output of the delay flip-flop $DF_{116}$.

Figure 9:
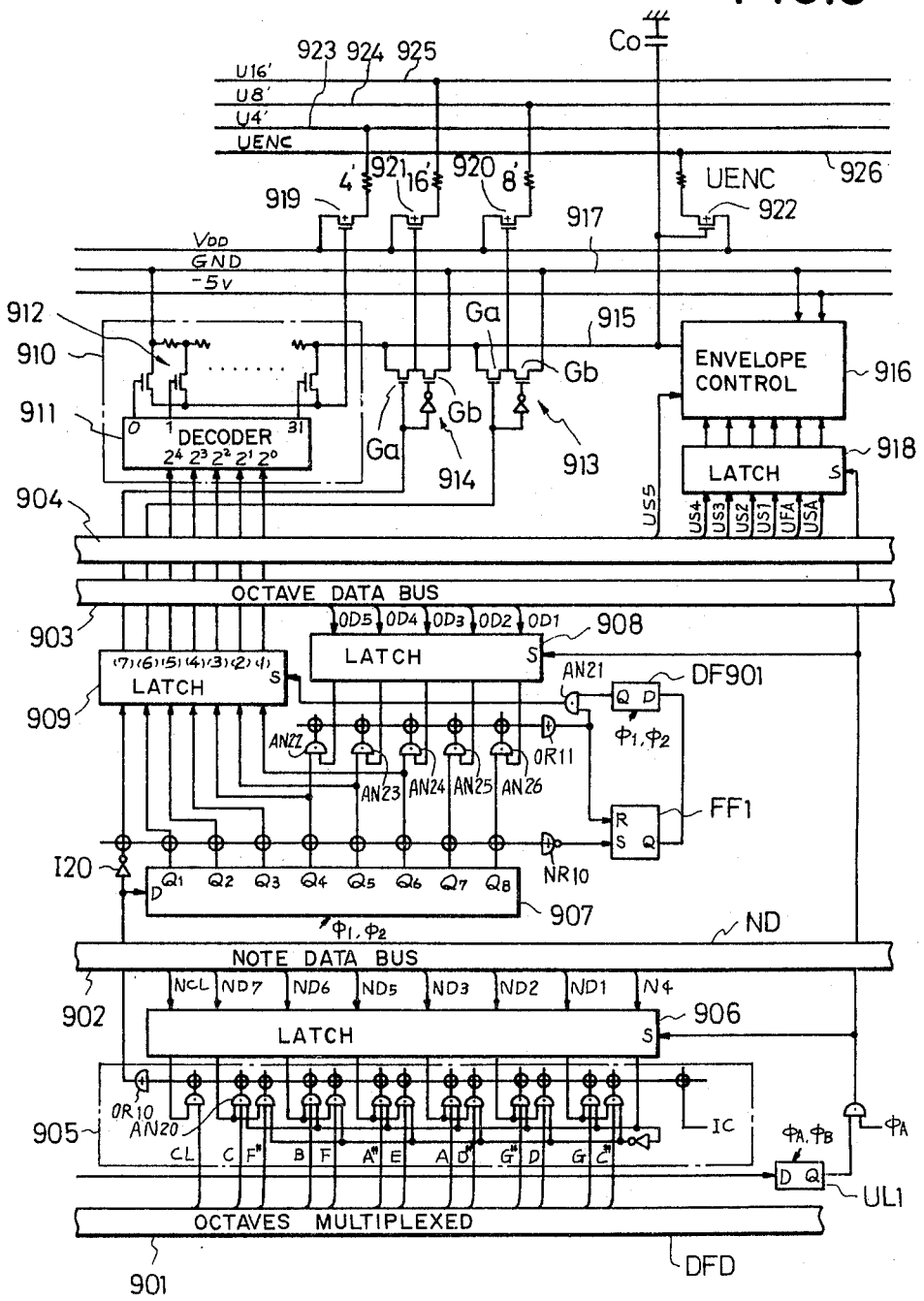
FIG. 9 is a circuit diagram showing an example of an upper keyboard tone generator shown in FIG. 7.

FIG. 9 shows an example of a circuit construction of the upper keyboard tone generator $UTG_1$ as an example of the upper keyboard tone generators $UTG_1$–$UTG_7$. The other upper keyboard tone generators $UTG_2$–$UTG_7$ are constructed in the same manner as the tone generator $UTG_1$.

The upper keyboard tone generator $UTG_1$ generates a tone source signal corresponding to an upper keyboard tone assigned to the fourth channel in accordance with octaves multiplexed data DFD supplied from an octaves multiplexed signal generation section 83 and the note data ND, the octave data OD and the upper keyboard tone envelope control data UED for the upper keyboard tone assigned to the fourth channel which is loaded in the latch circuit $UL_1$. The octaves multiplexed data generation section 83, which is not shown in detail, comprises, for example, twelve digital type octaves multiplexed signal generation circuits corresponding to twelve note names C#, D, D# . . . , C and each circuit generates serial submultiple frequency data $F_1$–$F_8$ corresponding to the same-named octave-different notes. Each of the submultiple frequency data $F_1$–$F_8$ contains signals for a plurality of frequencies corresponding to the same-named notes of the respective octaves. Take, for example, the frequency data $F_1$–$F_8$ corresponding to the note C. Data $F_1$ is a signal "1" representing the head of the submultiple frequency data. Data $F_2$ represents a signal of the highest frequency (the highest octave) in the frequency signals concerning the note C and repeatedly alternates "1" and "0" according to the master pulse corresponding to the note C. Data $F_3$ represents a frequency obtained by dividing the frequency represented by the data $F_2$ by two. Therefore the data $F_3$ changes once every time the data $F_2$ has changed twice. Data $F_4$ represents a frequency obtained by dividing the frequency represented by the data $F_2$ by four. Data $F_5$ represents a frequency obtained by dividing the frequency represented by the data $F_2$ by eight. Data $F_6$ represents a frequency obtained by dividing the frequency represented by the data $F_2$ by sixteen. Data $F_7$ represents a frequency obtained by dividing the frequency represented by the data $F_2$ by thirty-two. Data $F_8$ represents a frequency obtained by dividing the frequency represented by the data $F_2$ by sixty-four. As a digital type octaves multiplexed signal generating circuit, a submultiple-related-frequency wave generator disclosed in the specification of U.S. Pat. No. 4,228,403 entitled "Submultiple-Related-Frequency Wave Generator" may be employed.

Referring to FIG. 9, the octaves multiplexed data DFD ($F_1$–$F_8$) corresponding to the respective note names $C_L$, C#–C is applied to a note select circuit 905. The note name $C_L$ denotes the note C of the lowest octave. The note select circuit 905 comprises an AND gate group and selects the octaves multiplexed data DFD ($F_1$–$F_8$) corresponding to the note data of the upper keyboard tone assigned to the fourth channel is response to the outputs of a latch circuit 906 to which the note data ND is loaded from a note data bus 902. Assume, for example, that the note C ($N_4$–$N_1$=1100) of the fourth octave ($B_3$–$B_1$=011) has been assigned to the fourth channel. In this case, the note code ND has a signal "1" in the signal $ND_{4,7}$ and $N_4$ as shown in Table 4. Accordingly, an AND gate $AN_{20}$ of the note select circuit 905 is enabled and the octaves multiplexed data DFD ($F_1$–$F_8$) representing the note C is selected. The octaves multiplexed data $F_1$–$F_8$ selected by the note select circuit 905 is applied to 9-stage shift register 907 through an $OR_{10}$. As the leading signal $F_1$ of the octaves multiplexed data DFD is applied to the shift register 907, a NOR gate $NR_{10}$ is caused to produce a signal "1" by a signal obtained by inverting the signal $F_1$ by an inverter $I_{20}$ and reset-set type flip-flop $FF_1$ is set by this signal "1". Outputs $Q_4$–$Q_8$ of the fourth through eighth stages of the shift register 907 and an output of a latch circuit 908 to which is loaded corresponding octave data OD from an octave data bus 903 are applied to AND gates $AN_{22}$–$AN_{26}$. As the octaves multiplexed data DFD applied to the shift register 907 is sequentially shifted and the signal $F_1$ representing the head of the data has reached a stage corresponding to the octave data OD loaded in the latch circuit 908, one of the AND gates $AN_{22}$–$AN_{26}$ is enabled. If, for example, the octave data OD representing the fourth octave is loaded in the latch circuit 908, and AND gate $AN_{23}$ is enabled when the signal $F_1$ of the data DFD has reached the fifth stage of the shift register 907. An output signal "1" of the AND gate $AN_{23}$ thereupon is applied to an AND gate $AN_{21}$ through the OR gate $CR_{11}$ and enables the AND gate $AN_{21}$ which receives at the other input terminal thereof a signal obtained by delaying the output of the flip-flop $FF_1$ by 1 bit time (1 microsecond) by a delay flip-flop 901. An output signal "1" of the AND gate $AN_{21}$ is applied to the strobe terminal S of a latch circuit 909 and the output of the inverter $I_{20}$ and the outputs $Q_1$–$Q_5$ of the first through fifth stages of the shift register 907 at this moment are also applied to the latch circuit 909. The output of the OR gate $OR_{11}$ is applied to a reset terminal R of the flip-flop $FF_1$ thereby resetting the flip-flop $FF_1$.

Relation between the octaves multiplexed data $F_1$–$F_8$ loaded in the latch circuit 909 and the octave data OD loaded in the latch circuit 908 from the octave bus 903 is shown in the following Table 7:

TABLE 7

| latch circuit 908 | | | | | latch circuit 909 | | | | | | |
|---|---|---|---|---|---|---|---|---|---|---|---|
| $OD_1$ | $OD_2$ | $OD_3$ | $OD_4$ | $OD_5$ | 1 | 2 | 3 | 4 | 5 | 6 | 7 |
| 1 | 0 | 0 | 0 | 0 | $F_3$ | $F_4$ | $F_5$ | $F_6$ | $F_7$ | $F_8$ | 0 |
| 0 | 1 | 0 | 0 | 0 | $F_2$ | $F_3$ | $F_4$ | $F_5$ | $F_6$ | $F_7$ | $F_8$ |
| 0 | 0 | 1 | 0 | 0 | $F_1$ | $F_2$ | $F_3$ | $F_4$ | $F_5$ | $F_6$ | $F_7$ |
| 0 | 0 | 0 | 1 | 0 | 0 | $F_1$ | $F_2$ | $F_3$ | $F_4$ | $F_5$ | $F_6$ |
| 0 | 0 | 0 | 0 | 1 | 0 | 0 | $F_1$ | $F_2$ | $F_3$ | $F_4$ | $F_5$ |

In the octave multiplexed data $F_1$–$F_8$, the data $F_1$ of a rectangular wave is a signal which is constantly "1", the data $F_2$ is a signal with duty factor of 1:1 corresponding to the highest frequency of the note C and the data $F_3$–$F_8$ is signals obtained by frequency-dividing the data $F_2$ by 2, 4, 8, 16, 32 and 64, respectively. The frequency of the data $F_3$ corresponds to the frequency of the fifth octave in a 4-foot register. The frequency of the data $F_4$ corresponds to the frequency of the fourth octave in the 4-foot register, the frequency of the data $F_5$ to the frequency of the third octave in the 4-foot register, the frequency of the data $F_6$ to the frequency of the second octave in the 4-foot register and the data $F_7$ to the frequency of the first octave in the 4-foot register.

Signals of the first through fifth bits in the signal loaded in the latch circuit 909 are used for producing saw-tooth wave tone source signals of the 4-foot register a signal of the sixth bit is used for producing a rectangular wave tone source signal for an 8-foot register and a signal of the seventh bit is used for producing a rectangular wave tone source signal for a 16-foot register.

The 5-bit signal of the first through fifth bits outputted by the latch circuit 909 is applied to a waveform memory 910. The waveform memory 910 is a known circuit which stores sampled amplitude values of a waveform to be stored (a saw-tooth waveform) by means of voltage dividers network. The waveform memory 910 generates a 4-foot register saw-tooth wave tone source signal by decoding the applied 5-bit data by a decoder 911 and sequentially reading out sampled amplitude values stored in the voltage dividers network 912 in response to outputs of the decoder 911. The level of the saw-tooth wave tone source signal read from the waveform memory 910 depends upon the value of voltage on a line 915 which value of voltage is controlled by an envelope control circuit 915 to be described later.

The output of the sixth bit of the latch circuit 909 is applied to a gate circuit 913. The gate circuit 913 includes a gate Ga which is enabled when the applied signal is "1" to gate out the signal on the line 915 and a gate Gb which is enabled when the applied signal is "0" to gate out a signal on a line 917 of a ground level. The gate circuit 913 therefore produces a rectangular wave tones source signal for the 8-foot register depending upon the value of voltage on the line 915. The output of the seventh bit of the latch circuit 909 is applied to a gate circuit 914 which is of the same construction as the gate circuit 913 and a rectangular wave tone source for the 16-foot register is generated from the gate circuit 914.

The envelope control circuit 916 controls the value of voltage on the line 915 in accordance with the output of a latch circuit 918 to which the upper keyboard tone envelope control data UED for the upper keyboard tone assigned to the fourth channel is loaded from an upper keyboard tone envelope control data bus 904 and thereby imparts the saw-tooth wave tone source signal read from the waveform memory 910 and the rectangular wave tone source signals produced by the gate circuit 913 and 914 with predetermined envelope shapes.

Figure 10:
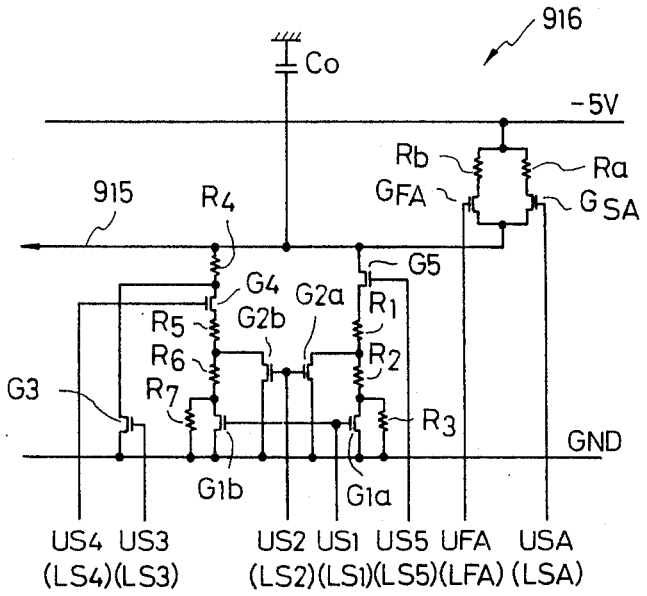
FIG. 10 is a circuit diagram showing an example of an envelope control circuit shown in FIG. 9.

FIG. 10 shows an example of the envelope control circuit 916 in detail. The circuit shown in FIG. 10 controls the value of voltage on the line 915 by utilizing charging and discharging of a capacitor $C_0$. Time constant for changing of the capacitor $C_0$ is controlled by switching of resistors Ra and Rb and time constant for discharging is controlled by switching and combining resistors $R_1$–$R_7$. The switching of the resistors Ra and Rb is effected by the signals USA and UFA in the upper keyboard envelope control data UED. When the signal USA is present, a data GSA is enabled and the resistor Ra thereby is selected whereas when the signal UFA is present, a gate GFA is enabled and the resistor Rb thereby is selected. The value of resistance of the resistor Rb is set at a smaller value than that of the resistor Ra and, accordingly, the capacitor $C_0$ is quickly charged when the signal UFA is present so that the value of voltage on the line 915 rises quickly, imparting an attack type envelope.

The switching and combining of the resistors $R_1$–$R_7$ are effected by the signals $US_1$–$US_5$ in the upper keyboard tone envelope control data UED. Gates $G_{1a}$, $G_{1b}$, $G_{2a}$, $G_3$, $G_4$ and $G_5$ are respectively enabled in accordance with the signals $US_1$–$US_5$ and thereby compose resistance for controlling discharging of the capacitor $C_0$ by suitable combination of the resistors $R_1$–$R_7$. Relation between this resistance and the signals $US_1$–$US_5$ is shown in Table 8. In Table 8, values of resistance of the resistors $R_1$–$R_7$ are denoted by the same reference characters $R_1$–$R_7$. For the resistors $R_1$–$R_3$, resistors of a greater resistance value than the resistors $R_4$–$R_7$ are employed and the resistance value of the resistor $R_1$ is so set that it will be greater than a sum of resistance values of the resistors $R_4$, $R_5$, $R_6$ and $R_7$. In other words, resistance value of these resistors are so selected that the relation $R_1+R_2+R_3>R_1+R_2>R_1>R_4+R_5+R_6+R_7>R_4+R_5>R_4$ is established.

TABLE 8

| $US_1$ | $US_2$ | $US_3$ | $US_4$ | $US_5$ | resistance value |
|---|---|---|---|---|---|
| 0 | 0 | 0 | 0 | 0 | |
| 0 | 0 | 0 | 0 | 1 | $R_1 + R_2 + R_3$ |
| 1 | 0 | 0 | 0 | 1 | $R_1 + R_2$ |
| 0 | 1 | 0 | 0 | 1 | $R_1$ |
| 0 | 0 | 0 | 1 | 0 | $R_4 + R_5 + R_6 + R_7$ |
| 0 | 1 | 0 | 1 | 0 | $R_4 + R_5$ |
| 0 | 0 | 1 | 1 | 0 | $R_4$ |

If, for example, a signal in which the signals $US_1$ and $US_5$ only are "1" is applied as signals $US_1$–$US_5$, the gates $G_{1a}$, $G_{1b}$ and $G_5$ are enabled and the capacitor $C_0$ is discharged through the resistor $R_1$ and $R_2$ and the gate $G_{1a}$ so that the value of voltage on the line 915 is attenuated with a time constant which is determined by the sum of resistance value of the resistors $R_1$ and $R_2$. Accordingly, the outputs of the waveform memory 910 and the gate circuits 913 and 914 are provided with an envelope of a decay shape which goes attenuated in accordance with this time constant.

The signals $US_1$–$US_5$ correspond to the data $UGS_1$–$UGS_2$ generated by switching of the upper keyboard tone decay length setting switch 43 (FIG. 6) as was shown in Table 6. By switching the switch 43 sequentially toward the side of the contact $P_8$, resistance value of the resistors for the discharging purpose (i.e., resistance value formed by switching and combining of the resistors $R_1$–$R_7$) decreases with a resulting decrease in the decay time. By switching the switch 43 sequentially toward the side of the contact $P_1$, resistance value of the resistors for the discharging purpose increases with resulting increase in the decay time.

If a depressed key is released when the upper keyboard tone damping selection switch 42 (FIG. 6) is at its "ON" state (i.e., $\overline{KO_1}$="1",), the signal $US_3$ is compulsorily turned to "1". This causes the gate $G_3$ to be enabled and the capacitor Co thereby discharges through the resistor $R_4$ in accordance with a minimum time constant determined by the resistance value of the resistor $R_4$. Accordingly, the outputs of the waveform memory 910 and the gate circuit 913 and 914 are imparted with a quickly attenuating damping envelope shape. This damping envelope shape is the same one as is provided by switching the upper keyboard tone decay length setting switch 43 to the side of the contact $P_8$ and thereby setting the shortest decay length. It will be noted that a resistor for controlling the decay length is used for controlling damping.

The saw-tooth wave tone source signal of the 4-foot register from the waveform memory 910, the rectangular wave tone source signal for the 16-foot register from the gate circuit 913 and the rectangular wave tone source signal for the 8-foot register from the gate circuit 914 which have been provided with envelope shapes by the envelope control circuit 916 are respectively supplied through source-follower type field-effect transistors 919–921 on a tone source signal output line 923 for the 4-foot system upper keyboard tone, a tone source signal output line 924 for the 8-foot upper keyboard tone and a tone source signal output line 925 for the 16-foot upper keyboard tone. The voltage signal on the line 915 is outputted on a line 926 through source-follower type field-effect transistor 922. This signal UENC on the line 926 is used for cancelling a direct current component contained in the upper keyboard tone source signal.

Figure 11:
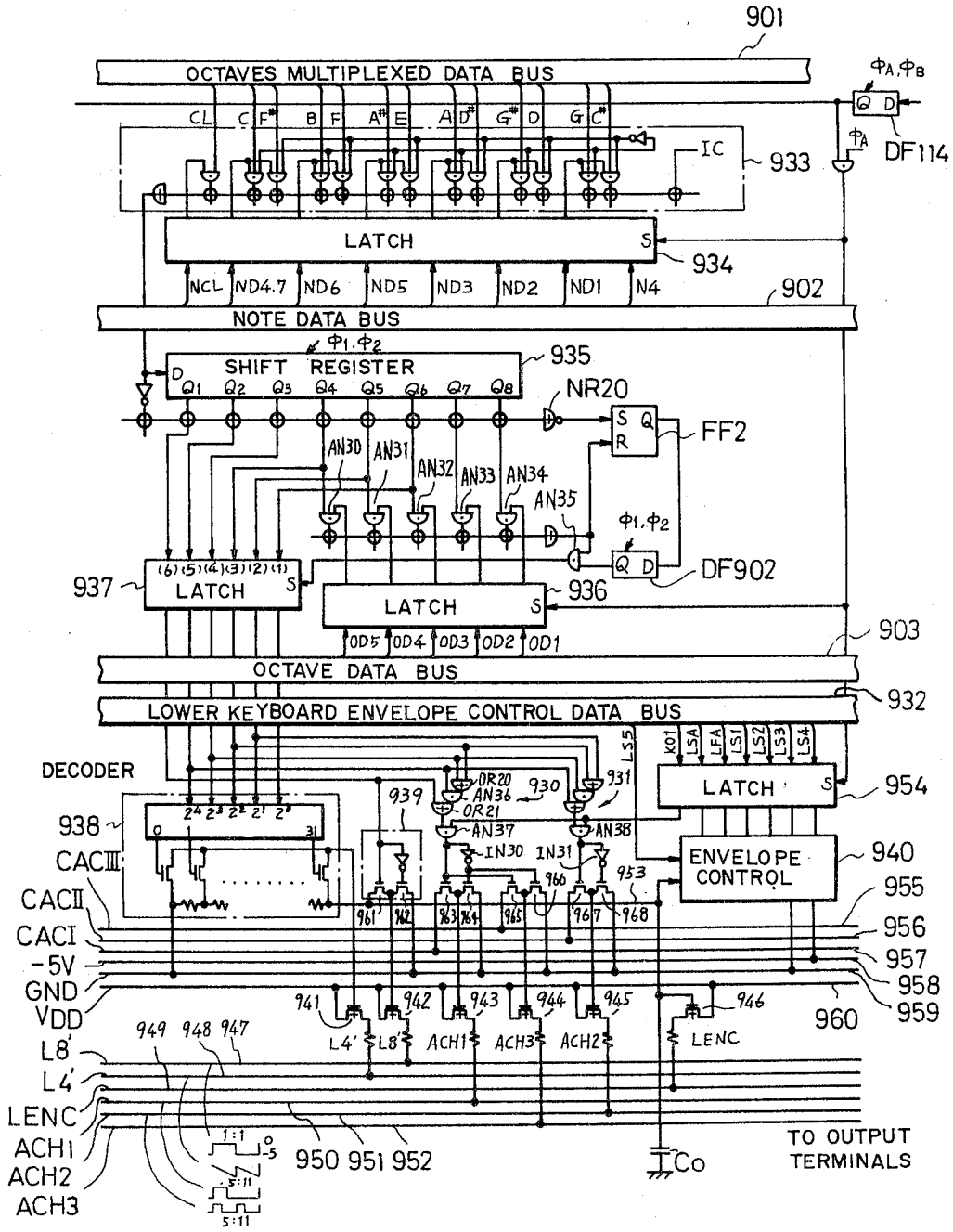
FIG. 11 is a circuit diagram showing an example of a lower keyboard tone generator shown in FIG. 7.

FIG. 11 shows an example of a circuit construction of the lower keyboard tone generator $LTG_7$ in detail. The other lower keyboard tone generators $LTG_1$–$LTG_6$ are of the same construction as the tone generator $LTG_7$.

The lower keyboard tone generator $LTG_7$ generates tone source signals corresponding to the lower keyboard tones and chord tones assigned to the ninth channel in accordance with the octaves multiplexed data DFD provided by the submultiple frequency data generation section 83 and note data ND, octave data OD and the lower keyboard tone envelope control data LED. The circuit shown in FIG. 11 is substantially of the same construction as the upper keyboard tone generator $UTG_1$ shown in FIG. 9 except for logical circuits 930 and 931 provided for forming tone source signals corresponding to chord tones. In the tone generator $LTG_7$, the octaves multiplexed data DFD corresponding to the tone assigned to the ninth channel is picked up from a octaves multiplexed data bus 901 by a note select circuit 933 in accordance with note data ND of this tone loaded in a latch circuit 934 from a note data bus 902. The selected data DFD is then applied to a shift register 935. A set-reset type flip-flop $FF_2$ is set by an output of a NOR gate $NR_{20}$ when the leading signal $F_1$ of the data DFD has been applied to the shift register 935. If a signal obtained by delaying the output of the flip-flop $FF_2$ by 1 bit time by a delay flip-flop DF 902 is "1", contents of 6 bits counting from the least significant bit of the shift register 935 are loaded in a latch circuit 937 in response to an output of an AND gate $A_{35}$ at a timing when an AND gate corresponding to the octave data concerning the ninth channel is enabled among AND gates $AN_{30}$–$AN_{34}$ which receive outputs of a latch circuit 936 in which the octave data OD concerning the ninth channel is loaded from an octave bus 903 and also outputs $Q_4$–$Q_8$ of 5 bits counting from the most significant bit of the shift register 935. The 4-foot saw-tooth wave tone source signal is read from a waveform memory 938 in response to outputs of 6 bits counting from the least significant bit of the latch circuit 937. The rectangular wave tone source signal is generated by controlling a gate circuit 939 by the sixth bit output of the latch circuit 937. The 4-foot saw-tooth wave tone source signal read from the waveform memory 938 and the 8-foot rectangular wave tone source signal outputted by the gate circuit 939 are imparted with predetermined envelope shapes by an envelope control circuit 940 which is operated by an output of a latch circuit 954 in which corresponding lower keyboard tone envelope control data LED from a lower keyboard tone envelope control data bus 932. These tone source signals thereafter are delivered respectively on a 4-foot register lower keyboard tone source signal output line 948 and on an 8-foot register lower keyboard tone source signal output line 947 through source follower type field-effect transistors 941 and 942. A signal on an envelope control line 953 provided by an envelope control circuit 940 is delivered on an output line 949 for a direct current component removal signal LENC through a source follower type field-effect transistor 946.

Figure 12:
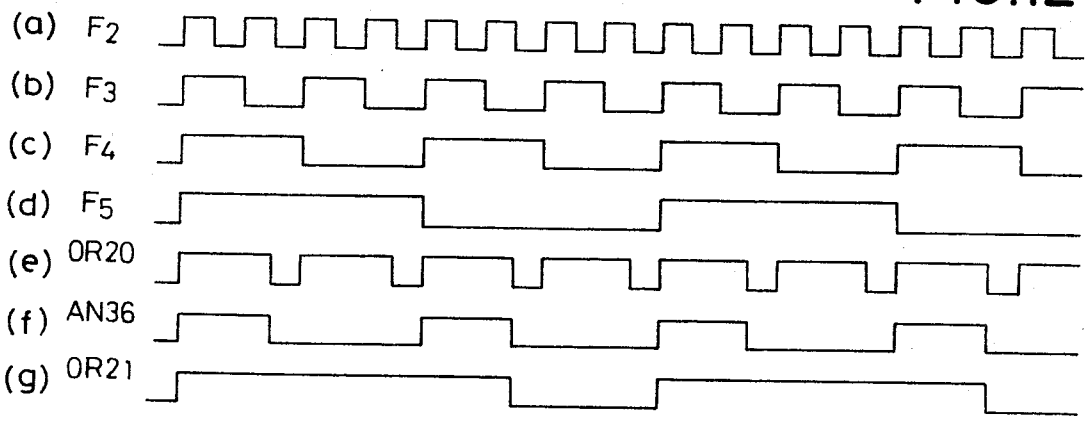
FIG. 12 is a time chart relation to some parts of operation of the circuit shown in FIG. 11.

The logical circuit 930 is a circuit provided for generating tone source signals $ACH_1$ and $ACH_3$ corresponding to chord tones controlled by the chord tone generation timing signals ACI and ACIII. This circuit 930 generates a rectangular wave with a duty factor of 5:11 by using outputs of the third through sixth bits of the latch circuit 937. The frequency divided data $F_2$–$F_8$ loaded in the latch circuit 937 consists, as described before, of the signal $F_2$ having duty factor of 1:1 and the signals $F_3$–$F_8$ having duty factor of 1:1 which are provided by frequency-dividing the signal $F_2$ by 2, 4, 8, 16, 32 by 64. If, accordingly, the signal $F_2$ which is stored in the third bit of the latch circuit 937 is a signal as shown in FIG. 12(*a*), the signals stored in the fourth through sixth bits of the latch circuit 937 are signals $F_3$, $F_4$ and $F_5$ as shown in FIGS. 12(*b*)–12(*d*) which are obtained by frequency dividing the signal $F_2$ shown in FIG. 12(*a*) by 2, 4 and 16. Accordingly, an output of an OR gate $OR_{20}$ of the logical circuit 930 to which the signal $F_2$ shown in FIG. 12(*a*) and the signal $F_3$ shown in FIG. 12(*b*) are applied assumes a shape shown in FIG. 12(*e*).

An output of an AND gate $AN_{36}$ which is enabled by the output of the OR gate $OR_{20}$ and the signal $F_4$ shown in FIG. 12(*c*) assumes a form as shown in FIG. 12(*f*) and an output of an OR gate $OR_{21}$ to which the output of the AND gate $AN_{36}$ and the signal $F_5$ shown in FIG. 12(*d*) assumes a form as shown in FIG. 12(*g*). This signal shown in FIG. 12(*g*) has the same frequency as the signal $F_5$ shown in FIG. 12(*d*) and has duty factor of 5:11.

The logical circuit 931 is a circuit for generating the tone source signal $ACH_2$ corresponding to the chord tone controlled by the chord tone generation timing signal ACII. This logical circuit 931 is of the same construction as the above described logical circuit 930, generating a rectangular wave having duty factor of 5:11 by using the outputs of the second through fifth bits of the latch circuit 937. In comparison with the logical circuit 930 which uses the outputs of the third through sixth bits of the latch circuit 937, the logical circuit 931 uses the outputs of the second through fifth bits of the latch circuit 937 and, accordingly, the signal outputted by the logical circuit 930 represents a tone which is one octave higher than a tone represented by the signal outputted by the logical circuit 931.

Signals having duty factor of 5:11 are formed in the logical circuits 930 and 931 because the chord tone source signals can contain more harmonic components and thereby can have a richer tone color by converting duty factor from 1:1 to 5:11.

The output of the logical circuit 930 is applied, through an AND gate $AN_{37}$ gated by the key-on signal $KO_1$ which is latched by a latch circuit 954, to a gate 963 which gate controls a signal $CAC_1$ on an envelope control line 957 for the tone source signal $ACH_1$. The output of the logical circuit 930 also is applied through the AND gate $AN_{37}$ to a gate 965 which gate controls a signal CACIII on an envelope control line 955 for the tone source signal $ACH_3$. An output of an inverter $I_{30}$ which inverts the output of the AND gate $AN_{37}$ is applied to gates 964 and 966 which gate control a signal on a ground line 959. The output of the logical circuit 931 is likewise applied through an AND gate $AN_{38}$ gated by the key-on signal $KO_1$ to a gate 967 which gate controls a signal CACII on an envelope control line 956 for the tone source signal $ACH_2$. An output of an inverter $I_{31}$ which inverts the output of the AND gate $AN_{38}$ is applied to a gate 968 which gate controls a signal on a ground line 958.

The envelope control signals CACI–CACIII on the envelope control lines 957, 956 and 955 for the automatic chord tone source signals $ACH_1$–$ACH_3$ are controlled by the automatic chord envelope control section 84.

Figure 13:
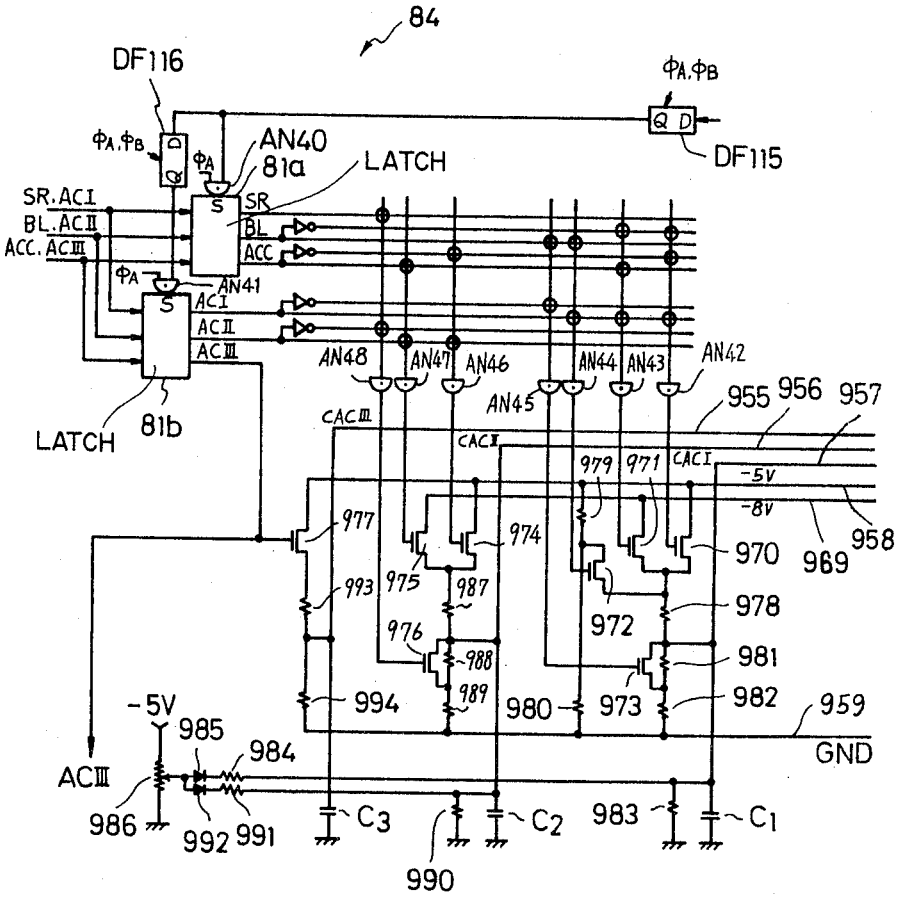
FIG. 13 is a circuit diagram showing an example of an envelope control circuit portion for the automatic chord performance shown in FIG. 7.

FIG. 13 shown an example of a circuit construction of the envelope control section 84 in detail. The slow rock selection signal SR, the ballade selection signal BL and the accent signal ACC are loaded in a latch circuit 81*a* in response to an output of an AND gate $AN_{40}$ which gates out the output of the delay flip-flop $DF_{115}$ upon receipt of the clock pulse $\phi_A$. Likewise, the chord tone generation timing signals ACI–ACIII are loaded in a latch circuit 81*b* in response to an output of an AND gate $AN_{41}$ which gates out the output of the delay flip-flop $DF_{116}$ upon receipt of the clock pulse $\phi_A$. The envelope control section 84 controls the envelope control signals CACI–CACIII by controlling charging and discharging of the capacitors $C_1$–$C_3$ in accordance with these signals SR, BL, ACC and ACI–ACIII.

Description will first be made with respect to a charging and discharging of the capacitor $C_1$ which controls the envelope control signal CACI on the line 957. The charging of the capacitor $C_1$ is controlled by outputs of AND gates $AN_{42}$–$AN_{44}$ which are enabled by logical conditions of the signals BL, ACC and ACI. Logical conditions $A_1$–$A_3$ of the AND gates $AN_{42}$–$AN_{44}$ are expressed by the following logical formulas:

$$A_1 = \overline{BL} \cdot \overline{ACC} \cdot ACI$$

$$A_2 = \overline{BL} \cdot \overline{ACC} \cdot ACI$$

$$A_3 = BL \cdot ACI$$

If the chord tone generation timing signal ACI is produced when neither the ballade selection signal BL nor the accent signal ACC is present, the AND gate $AN_{42}$ is enabled. This in turn enables a gate 970 by the output of the AND gate $AN_{42}$ thereby causing the capacitor $C_1$ to be charged by voltage of −5 V on a line 958 through a resistor 978. If the chord tone generation timing signal ACI is produced when the ballade selection signal BL is not present and the accent signal ACC is present, the AND gate $AN_{43}$ is enabled and a gate 971 is enabled by the output of the AND gate $AN_{43}$ thereby causing the capacitor $C_1$ to be charged by voltage of −8 V on a line 959 through a resistor 978. A peak value of the envelope control signal CACI on the line 957 thereby is raised to voltage of −8 V and the accent effect is provided. If the chord tone generation timing signal ACI is produced when the ballade selection signal BL has been selected, an AND gate $AN_{44}$ is enabled and a gate 972 is enabled by the output of the AND gate $AN_{44}$. The capacitor $C_1$ thereupon is charged through a resistor 978 by voltage of −2.5 V obtained by dividing the voltage of −5 V on the line 958 by resistors 979 and 980. A peak value of the envelope control signal CACI on the line 957 is lowered to voltage of −2.5 V. This arrangement is necessary, for otherwise the listener feels as if the tone level were increased because the tone produced becomes a prolonged tone when the selected rhythm is ballade.

Discharging of the capacitor $C_1$ is controlled by the output of an AND gate $AN_{45}$. A logical condition $A_4$ of the AND gate $AN_{45}$ is expressed by a logical formula:

$$A_4 = BL \cdot \overline{ACI}$$

Alternatively started, the AND gate $AN_{45}$ is disabled when the ballade selection signal BL is not present and the capacitor $C_1$ is discharged through a channel via resistors 981 and 982, a channel via a resistor 983 and a channel via a resistor 984, a diode 985 and a voltage setting circuit 986. The last mentioned channel via the resistor 984, diode 985 and voltage setting circuit 986 is provided for forming a decaying shape of two stages. When voltage of the capacitor $C_1$ has reached a set value, the diode 985 is turned off and this discharging channel is interrupted. Since, however, the AND gate $AN_{45}$ is enabled when the ballade selection signal BL is present and the gate 973 is enabled by the output of the AND gate $AN_{45}$ causing the resistor 981 to be short-circuited, the resistance for discharging of the capacitor C decreases as a whole thereby shortening the sustain time. This arrangement is made because the produced tone becomes a prolonged tone when ballade is selected as described before.

Charging of the capacitor $C_2$ for controlling the envelope control signal CACII on the line 956 is controlled by outputs of AND gates $AN_{46}$ and $AN_{47}$. Logical conditions $A_5$ and $A_6$ of the AND gates $AN_{46}$ and $AN_{47}$ are expressed by the following logical formulas:

$$A_5 = \overline{ACC} \cdot ACII$$
$$A_6 = ACC \cdot ACII$$

If the chord tone generation timing signal ACII is produced when the accent signal ACC is not present, the AND gate $AN_{46}$ is enabled and a gate 974 is enabled by the output of the AND gate $AN_{46}$ thereby causing the capacitor $C_2$ to be charged by voltage of $-5$ V on the line 958 through a resistor 987. If the chord tone generation timing signal ACII is produced when the accent signal ACC is present, the AND gate $AN_{47}$ is enabled and a gate 975 is enabled by the output of the AND gate $AN_{47}$ thereby causing the capacitor $C_2$ to be charged by voltage of $-8$ V on the line 969 through the resistor 987. Accordingly, a peak value of the envelope control signal CACII is raised to $-8$ V.

Discharging of the capacitor $C_2$ is controlled by an output of an AND gate $AN_{48}$. A logical condition of the AND gate $AN_{48}$ is expressed by a logical formula $A_7 = SR \cdot \overline{ACII}$ If the chord tone generation timing signal ACII is turned to "0" when the slow rock selection signal SR is not present, the capacitor $C_2$ is discharged through a channel via resistors 988 and 989, a channel via a resistor 990 and a channel via a resistor 991, diode 992 and a voltage setting circuit 986. If the slow rock signal SR is present, the gate 976 is enabled and the resistor 988 is short-circuited so that the resistance for discharging of the capacitor $C_2$ decreases as a whole and the sustain time thereby is shortened. This arrangement is made because the slow rock has a dense pattern.

Charging and discharging of the capacitor $C_3$ for controlling the envelope control signal CACIII on the line 955 are controlled by the chord tone generation timing signal ACIII. If the chord tone generation timing signal ACIII is produced, a gate 977 is enabled and the capacitor $C_3$ is charged by voltage of $-5$ V on the line 958 through a resistor 993. If the chord tone generation timing signal ACIII is turned to "0", the capacitor $C_3$ is discharged through a resistor 994.

As described above, the envelope control signals CACI—CACII produced on the lines 957, 956 and 955 in accordance with charging and discharging of the capacitors $C_1$–$C_3$ control the levels of the signals outputted through the gates 963, 967 and 965 (FIG. 11) and thereby control the signals gated by the gates 963 and 964, the signals gated by the gates 967 and 968 and the signals gated by the gates 965 and 966 both in the envelope and tone generation. These signals from the gates 963 and 964, from the gates 967 and 968 and from the gates 965 and 966 are respectively outputted on automatic chord tone source signal output lines 950–952 through source-follower type field-effect transistors 943, 945 and 944.

The upper keyboard tone source signal UK, the lower keyboard tone source signal LK, the pedal keyboard tone source signal PK produced by the tone generator 80 (FIG. 1) and the automatic chord tones source signals $ACH_1$–$ACH_3$ provided from the chord tone source signal output lines 950–952 are applied to separate tone color forming filter circuits 91–96 where these signals are provided with desired tone colors.

On the other hand, the pattern generator 70 produces a rhythm pattern RP in accordance with the function data $FD_2$ representing a selected rhythm and being supplied from the function data detector 30. This rhythm pattern RP is applied to a filter circuit 97 where a rhythm tone of a desired tone color is formed.

Figure 14:
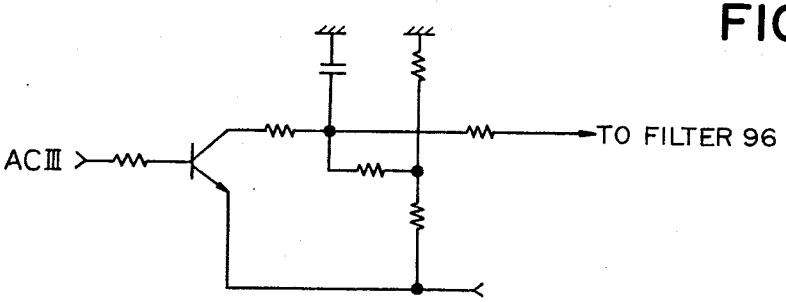
FIG. 14 is a circuit diagram showing an example of a wow pattern forming circuit shown in FIG. 1.

In the present embodiment of the electronic musical instrument, the filter circuit 96 to which the automatic chord tone source signal $ACH_3$ is applied is so constructed that it will produced a tone color which is called "attack-wow" or "music wow". The attack wow is a tone color peculiar to an electronic musical instrument and is produced by varying tone color of a musical tone by changing the frequency, phase or other element of a tone at the instant of depressing a key or at the start of producing a musical tone. In the prior art electronic musical instrument, the attack wow was produced by a signal generated by an oscillator specially provided for this purpose or by a signal produced in response to a key touch. According to the present invention, the attack wow is produced by utilizing the automatic chord performance tone generation pattern $AC_3$ stored in the pattern generator 70. The chord tone generation timing signal ACIII produced by the tone generator 80 in accordance with the automatic chord performance tone generation pattern $AC_3$ generated by the pattern generator 70 is applied to a wow pattern forming circuit 108. The wow pattern forming circuit 108 produces a predetermined wow pattern waveform in accordance with the applied chord tone generation timing signal ACIII. As the wow pattern forming circuit 108, an integration circuit as shown in FIG. 14 may be employed. The output of the wow pattern forming circuit 108 is applied to the filter circuit 96 at, for example, a cut-off frequency control terminal. The automatic chord tone source signal $ACH_3$ thereby is provided with a tone color which changes once at the rise of the tone, i.e., a wow effect.

Tone signals which have now been provided with desired tone colors by the filter circuit 91–97 are supplied to a sound system 100 through level adjusting resistors 101–107 for sounding of musical tones.

As described hereinabove, according to the present invention, three series of automatic chord tones are automatically played in accordance with three series of automatic chord performance tone generation patterns $AC_1$–$AC_3$ generated by the pattern generator 70, and simultaneous playing of chord tones with three kinds of tone colors thereby is made possible. If the automatic chord performance with a single tone color is desired, such performance can be made by making tone colors of the signals in the three filter circuit 94–96 identical or by causing an output of a specific filter circuit only to be applied to the sound system 100 by adjusting the level adjusting resistors 104–106. Further, by virtue of the arrangement that the lower keyboard key-on signal LKON generated by the assignment control section 64 is differentiated by utilizing the waiting time setting circuit 67 and the differentiated signal is used as the chord tone generation timing signal ACIII through the OR gate $OR_1$ the tone color of attack wow can be produced by the filter circuit 96 corresponding to the automatic chord tone source signal $ACH_3$ generated by depression of a key in the lower keybard.

What is claimed is:

1. An electronic musical instrument with an automatic chord performance device comprising:

a pattern generator including a memory for storing a plurality of automatic chord performance tone generating patterns, said plural patterns being read out concurrently as plural chord tone generation timing signals from said memory;

chord tone signal producing means for producing a complete set of chord tone signals having tone pitch relation constituting a chord to be played; and a plurality of envelope control circuits each separately, concurrently imparting an amplitude envelope to said complete set of chord tone signals in response to a respective one of said plural chord tone generation timing signals, so as to produce duplicates of said complete set of chord tone signals each with a respective different amplitude envelope pattern for the same one rhythm, and a common sound system for reproducing all of said duplicated sets of chord tone signals.

2. An electronic musical instrument as defined in claim 1 wherein the memory of said pattern generator further stores an accent signal at tone generation timing to be accented in each of said patterns.

3. An electronic musical instrument as defined in claim 1 which further comprises:

a rhythm selecting means, and wherein said memory stores the patterns for plural rhythms, a rhythm to be utilized being selected by said rhythm selecting means and wherein:

said envelope control circuits consist of a plurality of charging and discharging circuits each composed of a capacitor and resistors, a charge voltage of said charging and discharging circuit being varied in response to the selected rhythm.

4. An electronic musical instrument as defined in claim 3 wherein said charge voltage of said charging and discharging circuit is varied in response to means generating an accent signal.

5. An electronic musical instrument as defined in claim 3 wherein said charging and discharging circuit changes time constant for charging or discharging in accordance with the selected rhythm.

6. An electronic musical instrument as defined in claim 1 further comprising:

a filter circuit, connected at an input of said sound system, for controlling in a time varying manner the tone color of at least one of said amplitude envelope imparted, duplicated sets of chord tone signals in response to patterns generated by said pattern generator.

7. An electronic musical instrument as defined in claim 6 which further comprises an integration circuit for integrating the chord tone generation timing signals, said filter circuit changing frequency characteristics thereof in response to a signal from the integration circuit.

8. An electronic musical instrument with an automatic chord performance device comprising:

a pattern generator including a memory for storing plural sets of automatic chord performance tone generating patterns for plural selectable rhythms, each set being for each respective rhythm, at least one set including a plurality of different automatic chord performance tone generating patterns, said at least one set of said different patterns being read out from said memory as chord tone generation timing signals for one selected rhythm, chord tone signal producing means for producing chord tone signals of a tone pitch relation constituting a chord to be played, and an envelope control circuit for controlling the amplitude envelope of said chord tone signals in said different patterns concurrently in response to the respective ones of said read out set of chord tone generation timing signals.

9. An electronic musical instrument as defined in claim 8 which further comprises:

a filter circuit for controlling tone colors of said chord tone signals so that the chord tone signals of at least one of said different patterns has a different tone color from said chord tone signals of another of said different patterns.

10. In an electronic musical instrument having an automatic chord performance capability, the improvement comprising:

a rhythmic pattern generator producing, for each of certain selectable rhythms, plural concurrent tone generation timing signals, tone generator means for producing musical tone waveform signals corresponding to the tones of a selected chord, a common sound system having plural inputs, a first waveshape imparting means, connected between said tone generator means and one of said sound system inputs, for imparting to all of the tone waveform signals for said chord a first envelope waveshape having characteristics controlled by one of said plural timing signals, additional waveshape imparting means, each connected between said tone generator means and a respective other one of said plural sound system inputs, each for respectively imparting to all of the tone waveform signals for said chord respective envelope waveshapes each having characteristics respectively controlled by other ones of said plural timing signals, whereby said common sound system reproduces concurrently duplicated chords each having a respective imparted envelope waveshape of different characteristics and each with timings respectively established by said plural concurrent tone generating timing signals.

11. An electronic musical instrument according to claim 10 wherein:

said tone generator means comprises plural tone generators each generating a single tone, wherein:

said first and additional waveshape imparting means each comprises a like envelope generator circuit commonly connected to the output connections of all of said tone generators, and a set of output lines respectively associated with ones of said sound system plural inputs, one of said waveshape imparting means being associated with each of said output lines, so that the outputs of all tone generators are coupled to each output line under control of a respective one of said waveshape imparting means.

12. An electronic musical instrument according to claim 10 further comprising:

a separate tone color filter connected at each input to said common sound system so as to impart a respective tone color to the envelope imparted chord supplied to that sound system input.

13. An electronic musical instrument according to claim 10 further comprising:

"wow pattern" control means, associated with the particular filter of one of said sound system inputs, for modifying the characteristics of said particular filter only during a portion of chord tone production.

14. In an electronic musical instrument with an automatic chord performance device, the improvement comprising:

tone generator means for generating a set of musical tone waveform signals constituting a chord, plural envelope control means each for imparting a common envelope shape to a set of musical tone waveform signals, said chord constituting a set of musical tone waveform signals from said tone generator means being supplied in parallel to each of said plural envelope control means for separate envelope shaping thereby, and pattern generator means for concurrently supplying plural different tone generation timing signals associated with a single, selectable rhythm, each of said plural timing signals being separately supplied to a respective one of said envelope control means to control the envelope shape imparted thereby, whereby there are produced plural sets of said chord constituting musical tone waveform signals each set having a separately imparted envelope shape associated with a respective one of said tone generation timing signals.

15. An electronic musical instrument according to claim 14 further comprising:

a common sound system having a plurality of inputs, a tone color filter associated with each of said system inputs, each of said plural sets of envelope shape imparted, chord constituting musical tone waveshape signals from the respective envelope control means being supplied to a respective input of said sound system via a respective one of said filters.

16. An electronic musical instrument according to claim 15 and having an "attack wow" effect, comprising:

means for producing a "wow" control signal only at the beginning of generation of said chord constituting set of musical tone waveform signals, and means for modifying the characteristics of at least one of said filters in response to occurrence of said "wow" control signal.

* * * * *